US009553381B2

(12) United States Patent
Regnier

(10) Patent No.: US 9,553,381 B2
(45) Date of Patent: Jan. 24, 2017

(54) CONNECTOR SYSTEM WITH CABLE BY-PASS

(71) Applicant: Molex, LLC, Lisle, IL (US)

(72) Inventor: Kent E. Regnier, Lombard, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/916,347

(22) PCT Filed: Sep. 4, 2014

(86) PCT No.: PCT/US2014/054100

§ 371 (c)(1),
(2) Date: Mar. 3, 2016

(87) PCT Pub. No.: WO2015/035052

PCT Pub. Date: Mar. 12, 2015

(65) Prior Publication Data

US 2016/0197423 A1 Jul. 7, 2016

Related U.S. Application Data

(60) Provisional application No. 61/873,642, filed on Sep. 4, 2013.

(51) Int. Cl.

| | |
|---|---|
| ***H01R 12/71*** | (2011.01) |
| ***H01R 13/6473*** | (2011.01) |
| ***H01R 13/6587*** | (2011.01) |
| ***H01R 12/72*** | (2011.01) |
| *H01R 9/03* | (2006.01) |

(52) U.S. Cl.

CPC ..... *H01R 12/714* (2013.01); *H01R 12/721* (2013.01); *H01R 13/6473* (2013.01); *H01R 13/6587* (2013.01); *H01R 9/035* (2013.01)

(58) Field of Classification Search

CPC . H01R 12/714; H01R 12/721; H01R 13/6587; H01R 13/6586

USPC ..... 439/82, 65

See application file for complete search history.

(56) References Cited

U.S. PATENT DOCUMENTS

| | | | | |
|---|---|---|---|---|
| 6,053,770 | A | 4/2000 | Blom | |
| 6,095,872 | A | 8/2000 | Lang et al. | |
| 7,070,446 | B2 * | 7/2006 | Henry | H01R 13/65802 439/541.5 |
| 7,175,446 | B2 * | 2/2007 | Bright | H01R 23/688 439/79 |
| 7,534,142 | B2 * | 5/2009 | Avery | H01R 12/724 439/607.05 |
| 7,658,654 | B2 * | 2/2010 | Ohyama | H01R 13/114 439/752 |
| 7,824,197 | B1 * | 11/2010 | Westman | H01R 13/6586 439/108 |
| 8,162,675 | B2 * | 4/2012 | Regnier | H01R 9/038 439/76.1 |

(Continued)

*Primary Examiner* — Ross Gushi

(74) *Attorney, Agent, or Firm* — Stephen L. Sheldon

(57) ABSTRACT

A connector system is provided that includes a first connector and a second connector that are both coupled by a cable. Both connectors can be configured with terminal tails that are configured to be press-fit into a circuit board. The first connect - or includes a first terminal pair and the second connector includes a second terminal pair and the first and second terminal pairs are fixably connected to opposite ends of the cable.

14 Claims, 27 Drawing Sheets

(56) References Cited

U.S. PATENT DOCUMENTS 8,226,441 B2 * 7/2012 Regnier ..... H01R 9/038 439/626
8,398,433 B1 * 3/2013 Yang ..... H01R 13/6587 439/108
8,449,312 B2 * 5/2013 Lang ..... H01R 9/038 439/352
8,465,302 B2 * 6/2013 Regnier ..... H01R 9/038 439/108
8,540,525 B2 * 9/2013 Regnier ..... H01R 29/00 439/79
8,597,055 B2 * 12/2013 Regnier ..... H01R 9/038 439/626
8,740,644 B2 * 6/2014 Long ..... G02B 6/0001 439/541.5
8,753,145 B2 * 6/2014 Lang ..... H01R 9/038 439/527
8,992,236 B2 * 3/2015 Wittig ..... H01R 12/585 439/82
8,992,237 B2 * 3/2015 Regnier ..... H01R 29/00 439/108
9,028,281 B2 * 5/2015 Kirk ..... H01R 12/724 439/701
9,203,171 B2 * 12/2015 Yu ..... H01R 12/73
9,214,768 B2 * 12/2015 Pao ..... H01R 13/6587
9,246,251 B2 * 1/2016 Regnier ..... H01R 9/2408
9,312,618 B2 * 4/2016 Regnier ..... H01R 9/2408
9,350,108 B2 * 5/2016 Long ..... G02B 6/0001
9,385,455 B2 * 7/2016 Regnier ..... H01R 9/2408
9,391,407 B1 * 7/2016 Bucher ..... H01R 13/6581
9,413,112 B2 * 8/2016 Helster ..... H01R 13/6467
2003/0073331 A1 4/2003 Peloza et al.
2005/0142944 A1 6/2005 Ling et al.
2006/0216969 A1 * 9/2006 Bright ..... H01R 23/688 439/79
2007/0243741 A1 * 10/2007 Yang ..... H01R 13/4364 439/304
2011/0212633 A1 * 9/2011 Regnier ..... H01R 9/038 439/95
2011/0230104 A1 * 9/2011 Lang ..... H01R 9/038 439/676
2011/0300757 A1 * 12/2011 Regnier ..... H01R 29/00 439/626
2012/0003848 A1 * 1/2012 Casher ..... H05K 1/0222 439/65
2012/0034820 A1 * 2/2012 Lang ..... H01R 13/65802 439/660
2013/0092429 A1 * 4/2013 Ellison ..... H01R 12/523 174/264
2013/0340251 A1 * 12/2013 Regnier ..... H01R 29/00 29/876
2014/0073174 A1 * 3/2014 Yang ..... H01R 13/6461 439/485
2014/0073181 A1 * 3/2014 Yang ..... H01R 13/6471 439/607.01
2014/0335736 A1 * 11/2014 Regnier ..... H01R 9/038 439/638
2016/0013596 A1 * 1/2016 Regnier ..... H01R 12/585 439/607.35
2016/0104956 A1 * 4/2016 Santos ..... H01R 9/0518 324/754.03
2016/0181713 A1 * 6/2016 Peloza ..... H01R 12/724 439/630
2016/0190747 A1 * 6/2016 Regnier ..... H01R 9/2408 439/607.08
2016/0197423 A1 * 7/2016 Regnier ..... H01R 13/6473 439/59
2016/0233598 A1 * 8/2016 Wittig ..... H01R 12/515

* cited by examiner

CONNECTOR SYSTEM WITH CABLE BY-PASS

RELATED APPLICATIONS

This application is a national phase of PCT Application No. PCT/US2014/054100, filed Sep. 4, 2014, which in turn claims priority to U.S. Provisional Application No. 61/873,642, filed Aug. 4, 2013.

TECHNICAL FIELD

This disclosure relates to the field of connectors, more specifically to connectors suitable for use at high data rates.

DESCRIPTION OF RELATED ART

Switches, routers and other high performance equipment are used in data/telecom applications and tend to be capable of state-of-the-art performance. One example of the high performance that these devices can provide is the ability to support 100 Gbps Ethernet. This performance can be provided, for example, with a main circuit board that supports some number of processors (e.g., the silicon) and is positioned in a box that supports multiple input/output (IO) connectors (the external interface), QSFP-style connectors, for example, when designed appropriately can support four 25 Gbps channels (transmit and receive) so as to allow for a 100 Gbps bi-directional channel. Due to a number of issues, it is still strongly preferred to use non-return to zero (NRZ) encoding for such channels and therefor the channels need to support (at a minimum) 12.5 GHz signaling frequencies (or about 13 GHz). This means that the channel needs to provide accept loss characteristics up to 13 GHz (naturally, other issues such as cross-talk should be managed to higher frequency levels for a more desirable system).

In any communication channel there is a total loss budget available so as to ensure the signal to noise (s/n) ratio is sufficient. In other words, if a signal is transmitted, the signal needs to have enough power when it is received so that the receiving end can discern the signal from the noise. This s/n ration has started to become a problem because the distance between the silicon and the external interface may be 30-50 cm (or more), Most circuit boards are made of a FR4 laminate, which is a lossy medium. A laminate FR4 based circuit board, for example, tends to have attenuation from the dielectric alone that is about 0.1 dB/inch at 1 GHz and this attenuation tends to increase linearly with frequency. Thus, a FR4 board is expected to have a loss of at least 1.3 dB/inch at 13 GHz (more realistically, given other known losses, a loss of about 1.5 dB/inch is expected) and thus would result in a signal that was 20 dB down at about 15 inches (or more realistically 20 dB down at about 13 inches). Thus, the mechanical spacing required by the switch and router designs makes the use of FR4 impractical (or even impossible) due to the amount of the total loss budget that is used up in the circuit board between the silicon and the external interface.

One possible solution is to use other laminates, such as Nelco, which have a lower loss per inch. The use of other laminates, however, is somewhat undesirable as existing alternatives to FR4 laminates are more costly to implement in a circuit board, especially in the larger circuit boards that tend to be used in high performance applications. And even with the improved laminates the losses are still higher than desired. Therefore, certain applications would benefit from an improved solution that can help improve the attenuation issue.

SUMMARY

A connector system is provided that includes a first connector and a second connector that are both configured with terminal tails that are configured to be press-fit into a circuit board. The first connector includes a first terminal pair and the second connector includes a second terminal pair and the first and second terminal pairs are terminated to opposite ends of a cable that provides substantially improved attenuation performance compared to FR4 laminate circuit boards. The first terminal pair includes tails that are configured to be press-fit into a circuit board in an appropriate pattern. In a configuration the second terminal pair includes contacts that are configured to mate with another connector.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s), Therefore, unless otherwise noted, features disclosed herein may be combined together to form additional combinations that were not otherwise shown for purposes of brevity.

In a connector system there is inherently some number of interfaces. For example, in a QSFP connector that is attached to a circuit board with a SMT style connection, there is a first interface between a paddle card of a mating connector and a contact of a terminal provided in the QSFP connector. There is also a second interface between the terminal in the QSFP connector and the supporting pad in the circuit board. Thus, a connector inherently has two interfaces, one for the incoming signal and one for the outgoing signal. It has been determined that, particularly for high signaling frequencies, it is desirable to limit the number of interfaces provided. This is because each interface requires certain tolerances to allow for reliable mating and these tolerances tend to increase if the mating is supposed to be repeatable. While it is fairly straightforward to manage these tolerances for low signaling rates, as the signaling rates increase the size of the features that are used to provide a mating connection begin to cause significant problems. For example, when a paddle card mates to a terminal, a contact on the end of the terminal electrically connects to a pad on the paddle card. In order to provide a mechanical connection, the contact needs a curved end (commonly referred to as a stub) to ensure the contact does not stub when engaging the paddle card. The stub changes the mechanical size of the terminal and thus provides an impedance change. Similarly, the pad must be oversized to account for all the position tolerances of the contact so as to ensure the pad on the circuit card makes a reliable electrical connection with the contact. The size of the pad also causes a change in impedance. As a result, the impedance discontinuities in the interfaces can result in significant signal reflection (which causes signal loss). Therefore, as noted above, it is helpful to reduce the number of interfaces in a communication channel that is transmitting signals.

Figure 1:
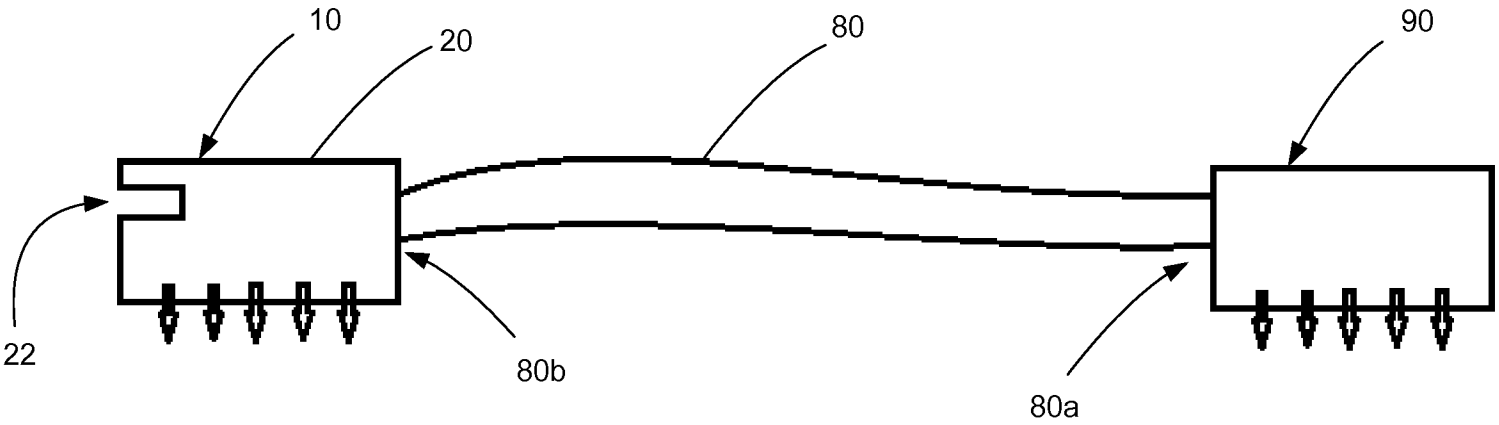
FIG. 1 illustrates a schematic view of an embodiment of connector system.

As can be appreciated from the depicted figures, a connector system can be provided that improves the performance compared to using an FR4 circuit board to transmit signals. This is particularly valuable in systems where there is a substantial distance between a transceiver and a connector that provides a mating interface to the transceiver, As depicted schematically, a first connector 90 and a second connector 10 are electrically connected together via a cable 80. The cable 80 includes a pair of conductors that act as a differential pair and the cable includes a first end 80*a* and a second end 80*b*. The first end 80*a* is terminated to a first signal pair in the first connector 90. The second end is terminated to a second signal pair in the second connector 10. Each of the terminals in the first signal pair has a tail that is configured to be press fit into a circuit board. In a first embodiment, such as is schematically represented in FIG. 1, each of the terminals in the second terminal pair includes a contact supported by the housing 20 and positioned in a card slot 22 that is configured to mate with a mating connector.

It should be noted that both the first connector 90 and the second connector 10 are configured to be attached to the circuit board via a press-fit connection. Thus, for an embodiment where the differential pair of terminals in the second connector 90 have contacts on one end and are terminated to the cable on the other end, the second connector 90 is still expected to have several other terminals with tails that are press-fit into the supporting circuit board (the other terminals can provide, for example, channels for timing and low data rate signaling). The ability for both sides to be attached with a press-fit connection avoids the need to have any type of soldering between the connectors in the connector system and the supporting circuit board (or boards in the case where two boards are positioned adjacent one another) and is expected to improve manufacturability of the corresponding system.

Figure 2:
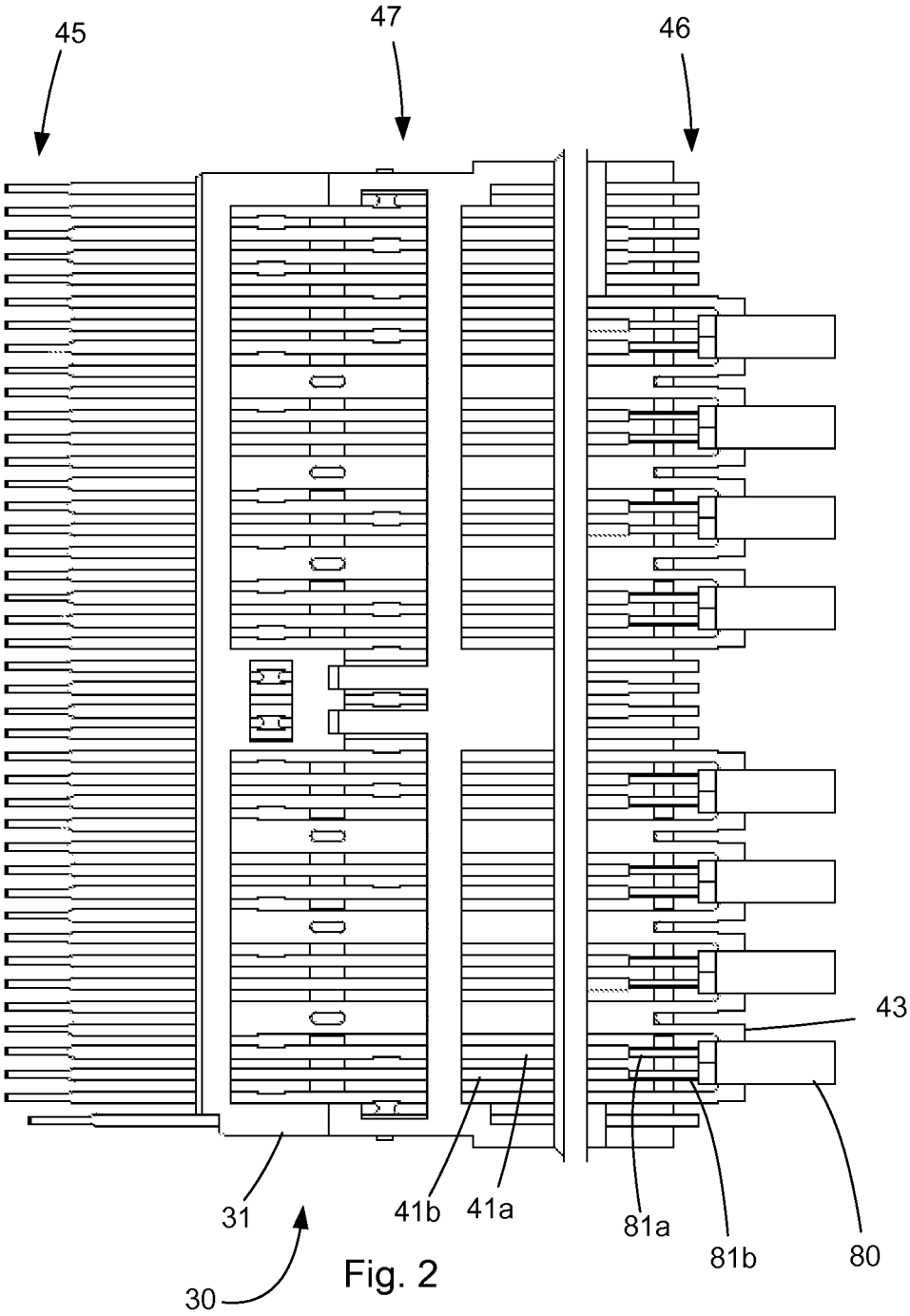
FIG. 2 illustrates a plan view of an embodiment of a wafer.
Figure 3:
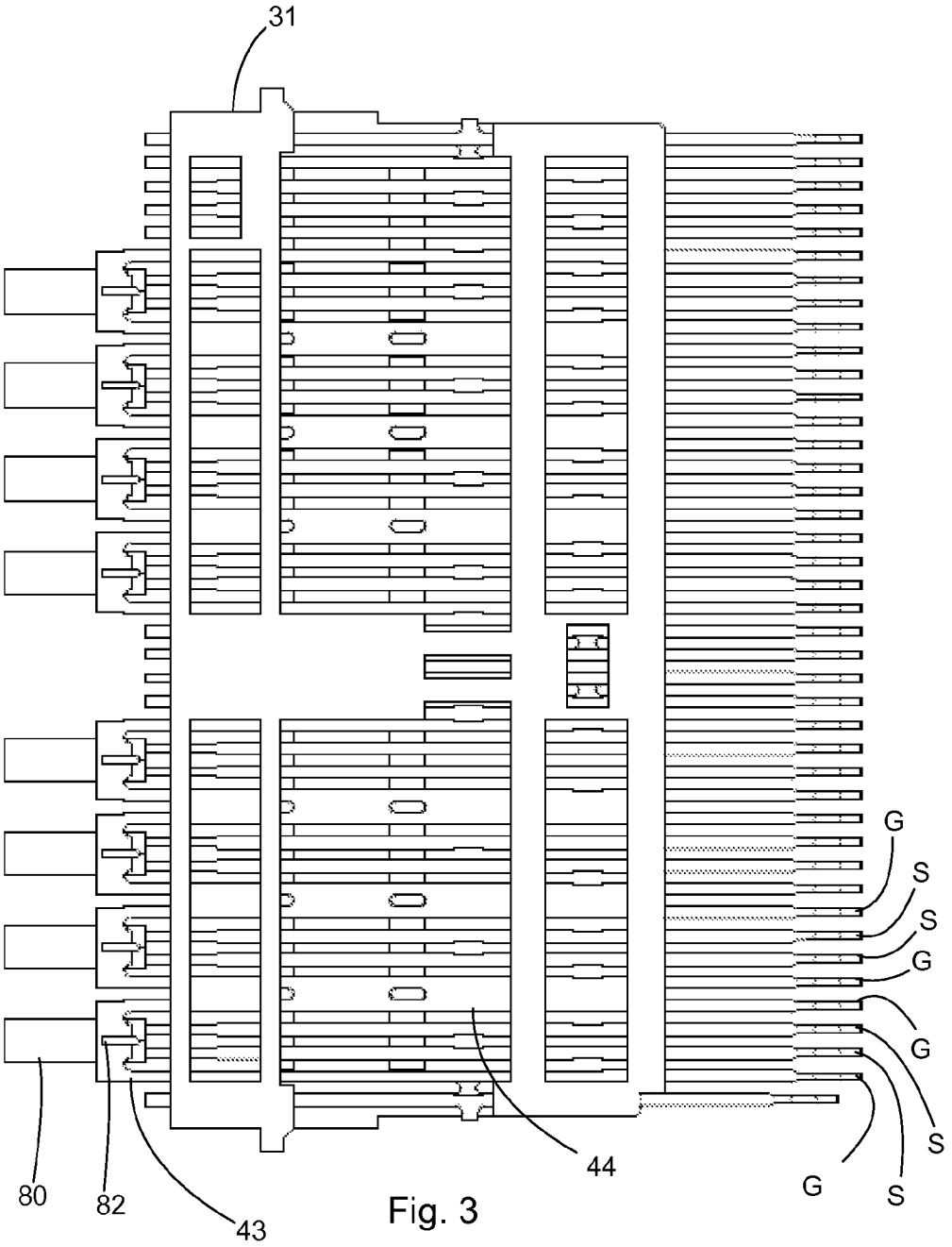
FIG. 3 illustrates a bottom view of the embodiment depicted in FIG. 2.

FIGS. 2 and 3 illustrate an embodiment of a wafer 30. The wafer 30 includes a frame 31 that supports signal terminals 41*a*, 41*b* and ground terminals 43. Each of the terminals includes contacts 45, tails 46 and bodies 47 extending therebetween. As can be appreciated, the ground terminal 43 has a number of terminals commoned together and includes a shielding portion 44 that extends between signal pairs. Thus, the wafer 30 can provide contacts arranged in multiple sets of a ground, signal, signal, ground pattern. Naturally, if there is less need for shielding then the double grounds and shielding portion 44 can be revised so that there is a single ground contact between the pair of signal contacts and the pattern would be a ground, signal, signal pattern.

It should be noted that the connector configuration shown in FIGS. 2 and 3 illustrate embodiments of a high performance connector but do not include tails (thus illustrating a wire-to-paddle card design). The basic construction can be used more flexibly. For example, two wafers as depicted in FIG. 3 (which can be supported by a housing and thus used to provide a connector) can be formed so that the terminals are interweaved with respect to each other. Thus, the features of a wafer as depicted in FIG. 3 could be provided by having two sub-wafers interweaved. Of course, the desirability of weaving two sub-wafers will depend on connector configuration. The wafer 30 of FIG. 2 is likely most suitable for use in a design that has a single card slot and in certain embodiments the connector would be configured to support two wafers 30, one flipped with respect to the other, so that the contacts could be provided on two sides of a card slot.

FIGS. 5-27 illustrate features that can be used an alternative embodiments. It should be noted that while multiple features are disclosed, not all the features need to be included in each embodiment as each feature will have a cost and therefore the performance benefit of that feature versus the cost may, in certain applications, suggest omission of the feature A connector system 110 includes a first connector 110*a* with a frame 189 and a second connector 110*b* coupled by a cable 180. The figures illustrates a simplified model in that multiple cables 180 are illustrated being terminated to the same terminals. In addition, certain cables 180 are depicted as being truncated and are not shown as being terminated, In practice, each cable could be terminated in a comparable manner and each cable would be terminated to a different set of terminals. Thus, in a non-simplified illustration connector 110*a* would have a frame 189 that supported additional terminals. However, for purposes of illustrate and depiction, it is simpler to use less examples with the understanding that the features can be repeated as needed, depending on the number of cables 180 that are used.

As depicted, connector 110*b* is supported by circuit board 112 while connector 110*a* is supported by circuit board 114. In many applications a single circuit board can be used to support both connectors 110*a*, 110*b*. As can be appreciated, for larger circuit boards, the cable(s) 180 can be configured to be longer (such as greater than 15 cm) so that one connector is mounted a significant distance apart from the other connector.

Connector 110*b* includes a housing 120 that includes a first card slot 122*a* and as depicted, also includes a second card slot 122*b*. Each of the card slots include a first side 123*a* and a second side 123*b*. It should be noted that the depicted design thus allows for a stacked connector (the two card slots are spaced apart vertically, thus the connector is "stacked") but is equally applicable to an application of a connector where only one card slot is desired. Therefore the depicted illustrates are exemplary but a connector with only one card slot is contemplated and would be a simple modification of the depicted embodiments. Paddle cards 105 can be inserted into the card slots so as to make electrical connection. The paddle cards 105 will typically be part of a mating connector system (not shown for purposes of clarity).

Each card slot includes at least one row 141 of contacts 145. It is common, similar to what is depicted, to have two rows of contacts in each card slot with one row of contacts on the first side 123*a* facing in a first direction and another row of contacts on the second side 123*b* facing an opposite direction. Thus, for example, cable 180*a* could be used to electrically connect to terminals on the first side 123*a* (e.g., in a top row) of the card slot while cable 180*b* could be used to electrically connector to terminals on the second side 123*b* (e.g., on a bottom row) of the card slot.

The housing 120 supports ground wafers 150, which each support a ground terminal 151 that can include legs 152. The ground terminal 151 can be configured with press-fit tails. The housing can also support low-speed signal wafers 170, which can be formed in a conventional manner with terminals that include contacts 145 and tails that are configured to be press fit into a circuit board. As such construction is well known, nothing further need be said about the low-speed signal terminals.

As depicted, a signal module 160 is positioned between two ground wafers 150. A U-shield 158 is positioned between the ground wafers 1150 and can provide shielding to signal channels on opposite sides of the card slot while electrically connecting ground terminals 151 in the ground wafers 150 on opposite sides of the U-shield 158. The U-shield also supports cable support 178, which along with cable support 177, helps ensure the cable 180 is secured in position and works to minimize strain on terminations between the cable and the terminals in the connectors. The cable support 177, which is optional, can be sandwiched between two ground wafers 150 and can include a projection that fits in a corresponding recess 150*b* that is provided on both sides of insulative web 150*a* of the ground wafer 150 so that it is secured to the ground wafers 150. The inclusion of the optional cable support 177 helps provide additional strain relief for the cable 180 and increases the robustness of the connector system but in certain applications may not be desired or beneficial. Of course, in an embodiment the cable support 178 could be omitted and just cable support 177 could be provided. While neither cable support is required, in practice it is expected that omitting both will make the connector system more susceptible to damage during installation and thus most applications will benefit from the inclusion of one or both cable supports.

As noted above, the U-shield 158 can be used to common terminals 151 in adjacent ground wafers 150. In an embodiment, the U-shield can include projections 159*a*-159*f* that are configured to engage fingers 153 in aperture 154 (typically with an interference fit). The depicted U-shield 158 has the projections 159*a*-159*f* configured such that one side has a projection in a forward position and the opposite side has a projection in a rearward position. The alternating positions allow the projections to overlap and engage adjacent fingers 153 in an aperture 154 of the shield wall 152 when the U-shield 158 is installed. While the depicted U-shield 158 has three projections on each side, in embodiment some other number of projections could be provided.

To improve electrical performance, the U-shield 158 can include a solder connector 158*a* to a shield provided on the cable 180. The U-shield also can provide an electrical termination for the ground wire 182 with termination groove 158*b*. As the U-shield 158 can be electrically connected to ground terminals 151 on both sides of the two signal terminals, the additional connection further improves the electrical performance of the connector system by reducing reflections that might otherwise exist due to the transition between the cable and terminals 164.

The cable 180 includes signal conductors 181*a*, 181*b* that are electrically connected to terminals 164 so as to provide signal terminals S1 and S2 (which can form a differential pair that are broad-side coupled). In an embodiment, the terminals 164 include terminal notches 167 and the signal conductors 181*a*, 181*b* are positioned in the terminal notches 167 and can be secured there with solder or conductive adhesive or the like.

The terminals 164, which include a body 166, are positioned in the signal module 160, which include a sub-wafer 161*a* and a sub-wafer 161*b* pressed against each other. Each sub-wafer can support multiple terminals 164 and in the depicted embodiment supports two terminals 164 with each terminal in the flipped orientation compared to the other. It should be noted that while the depicted embodiment uses two of the same terminals 164. The signal module 160 is therefore configured to provide contacts 145*a* and 145*b* on one side of a card slot and contacts 145*c* and 145*d* on the other side. The signal module 160 can be configured with projections 169*a*, 169*b* that engage the ground wafers 150 and helps control the position of signal module 160 relative to the ground wafers 150. In an embodiment the sub-wafers can formed by stitching terminals in a formed insulative structure. Alternative, the sub-wafer can be formed using an insert-molding operation.

The first connector 110*a*, which provides terminal for the cable 180, includes a housing 190 that supports terminals and is positioned in the frame 189 (which as noted above, can be sized to support a larger number of housings 190). The housing 190 includes a wall 191 that supports ground terminal 194 and that supports brick 191*a* and 191*b*. The brick 191*a* supports signal terminal 193*a* and brick 191*b* supports signal terminal 193*b*. The signal conductors 181*a*, 181*b* are electrically connected to signal terminals 193*a*, 193*b*, respectively, and the ground wire 182 is electrically connected to ground terminal 194. In an embodiment the conductors can be soldered to the terminals and each terminal can include a press-fit tail (which is omitted for purposes of clarity but can be any desirable press-fit style tail). To help secure the bricks 191*a*, 191*b* to the wall 191, a securing member 192 can be added. The securing member 192 can be provided with a potting material in a known manner.

Figure 4:
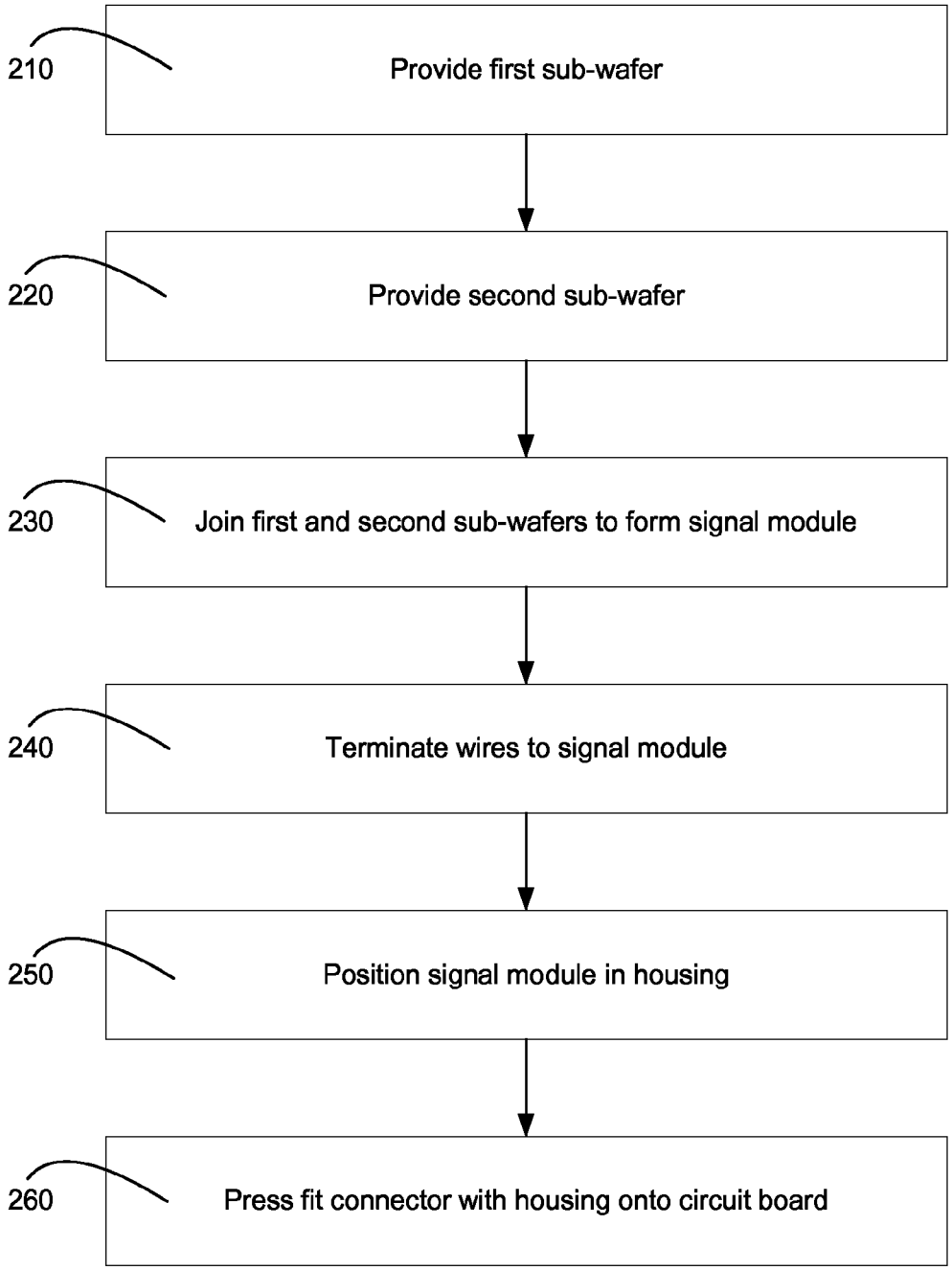
FIG. 4 illustrates a method of providing a connector on a circuit board.
Figure 5:
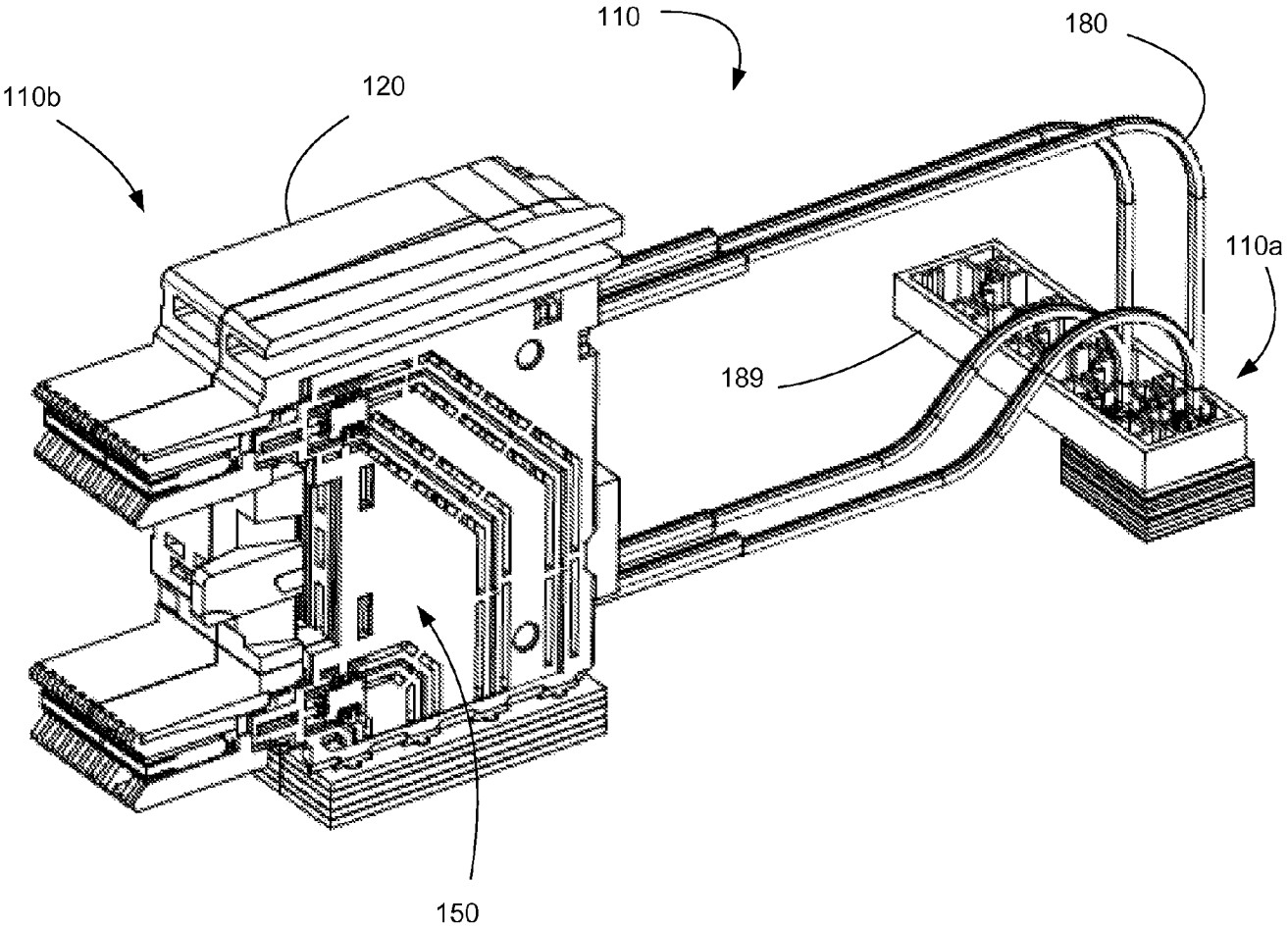
FIG. 5 illustrates a perspective view of an embodiment of a simplified version of connector system.
Figure 6:
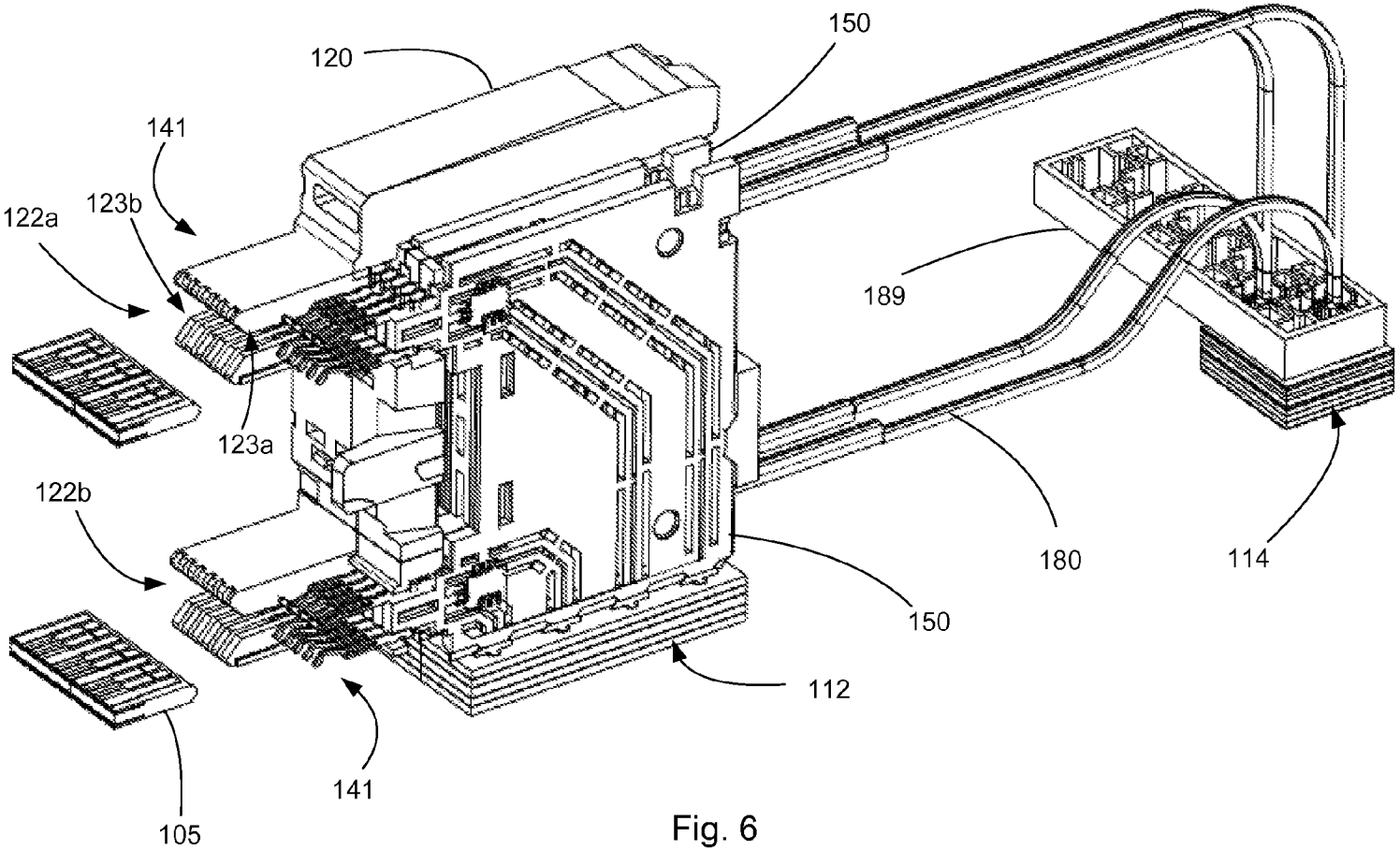
FIG. 6 illustrates a perspective view of a further simplified depiction of the embodiment depicted in FIG. 5.
Figure 7:
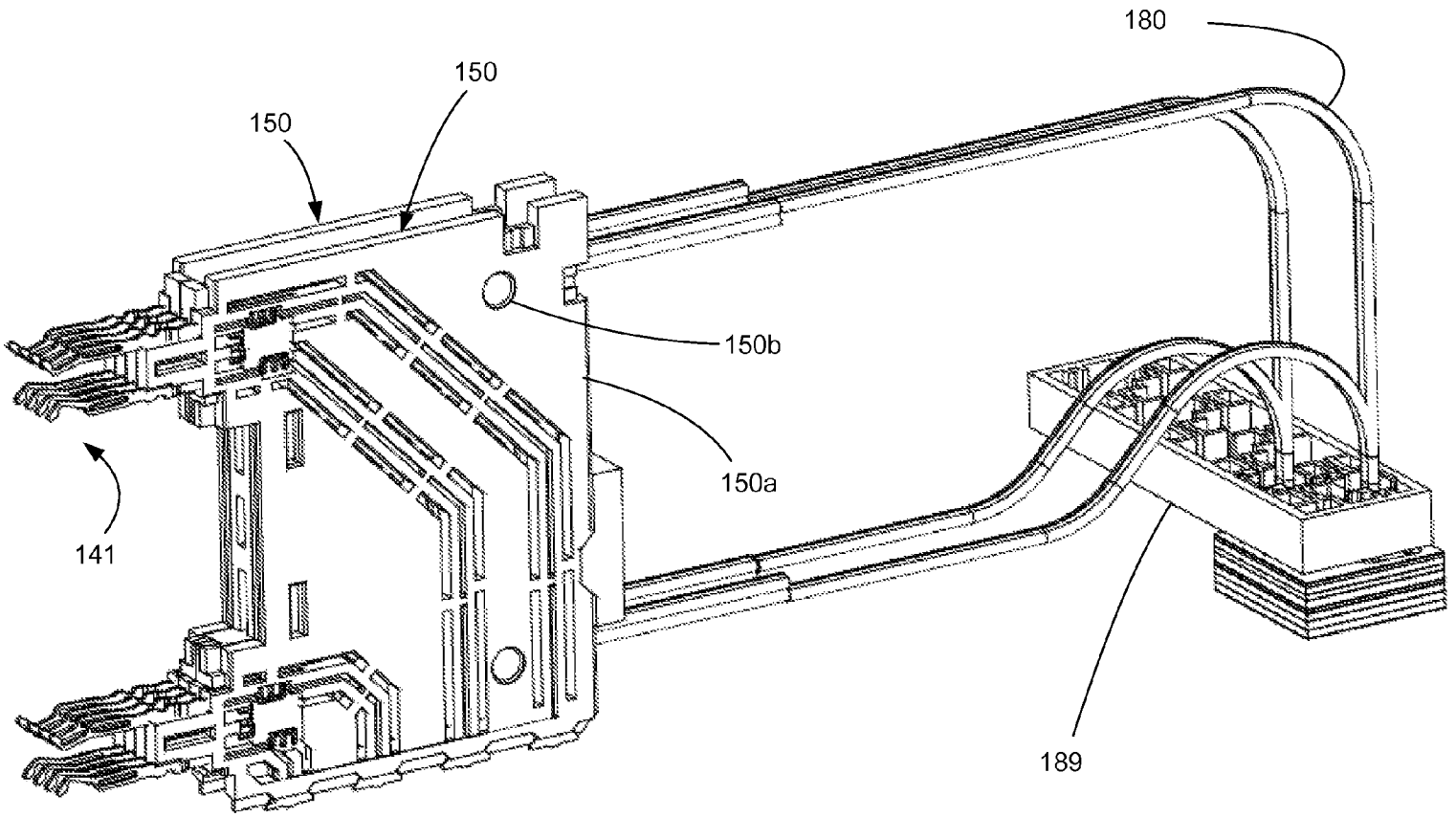
FIG. 7 illustrates a simplified perspective view of the embodiment depicted in FIG. 5.
Figure 8:
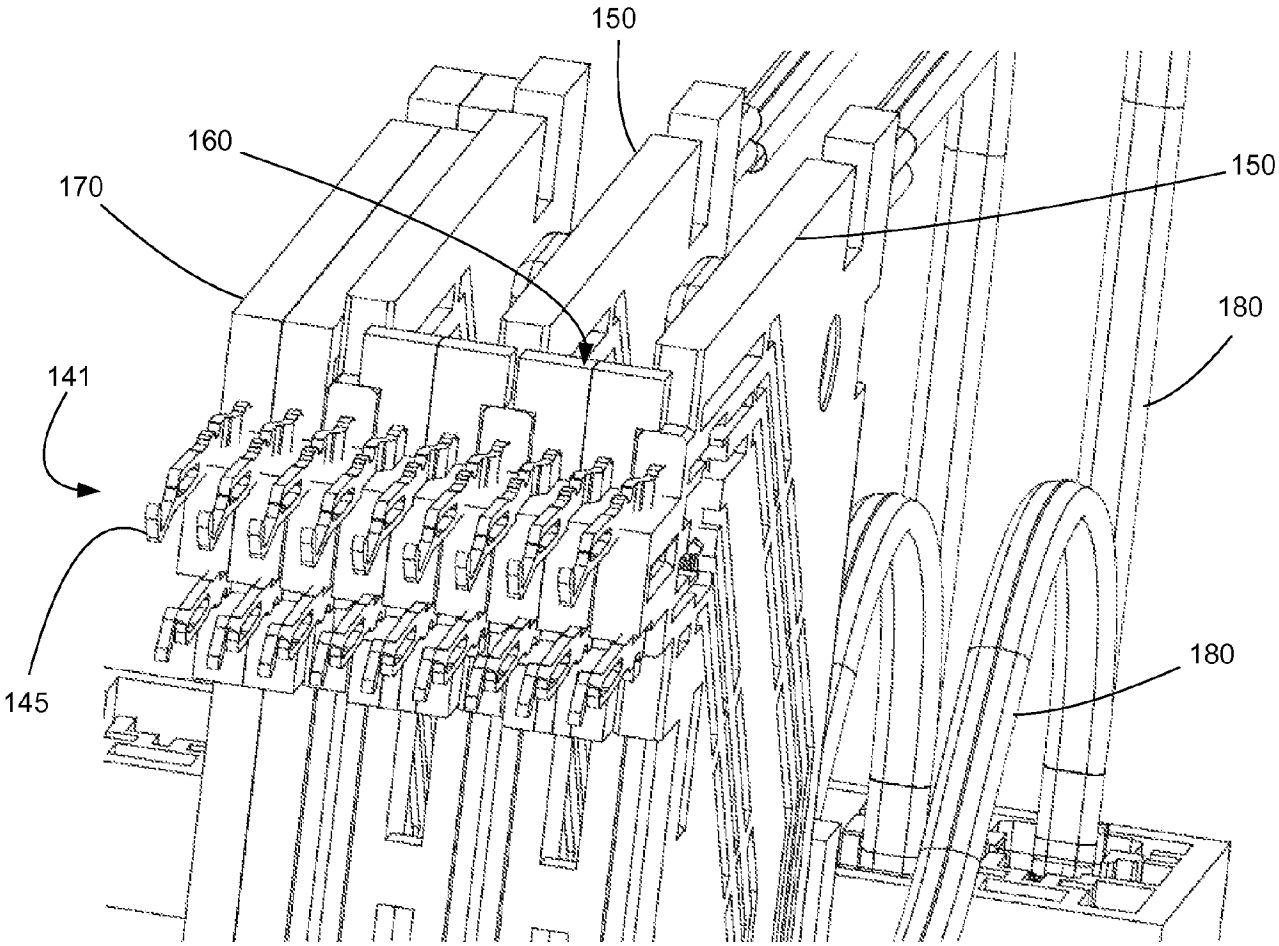
FIG. 8 illustrates an enlarged perspective view of the embodiment depicted in FIG. 5 with the housing removed.
Figure 9:
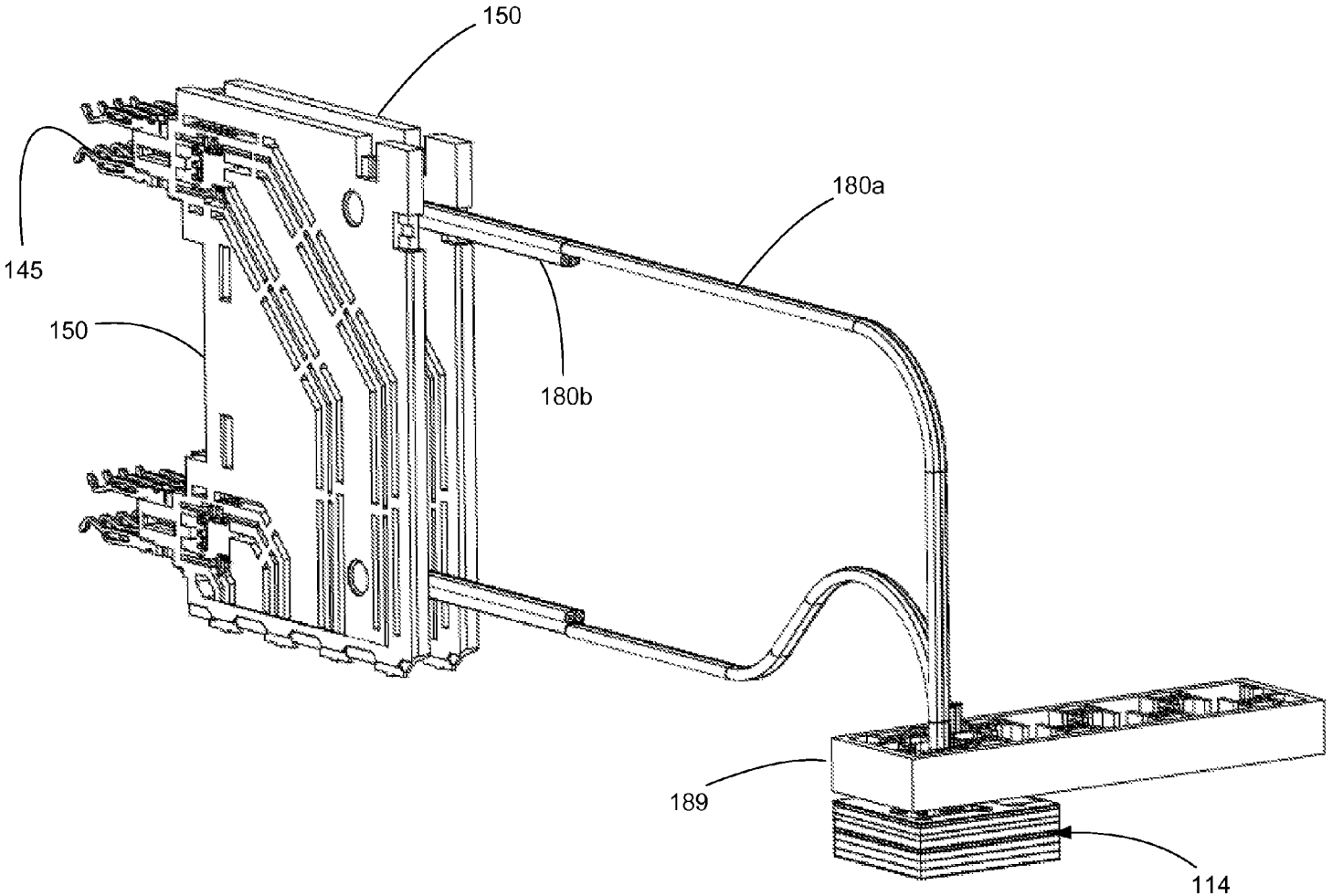
FIG. 9 illustrates another perspective view of the embodiment depicted in FIG. 7.
Figure 10:
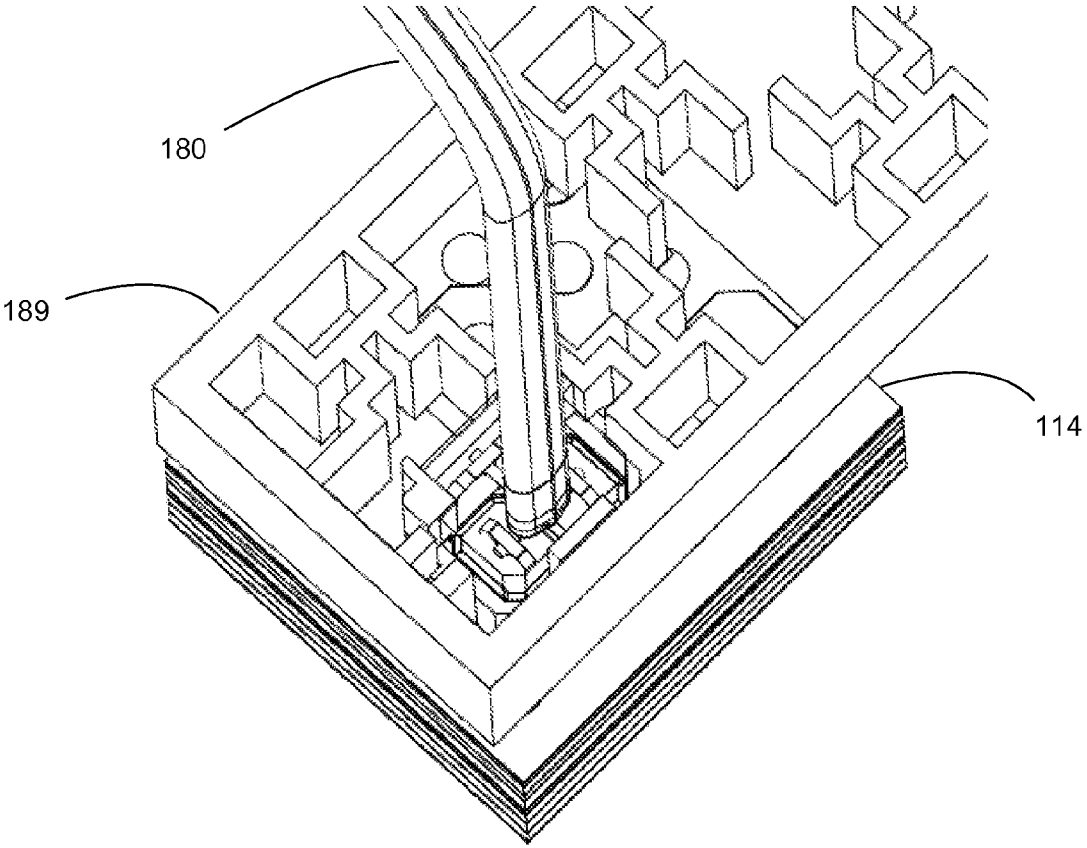
FIG. 10 illustrates a simplified perspective view of one of the connectors depicted in FIG. 5.
Figure 11:
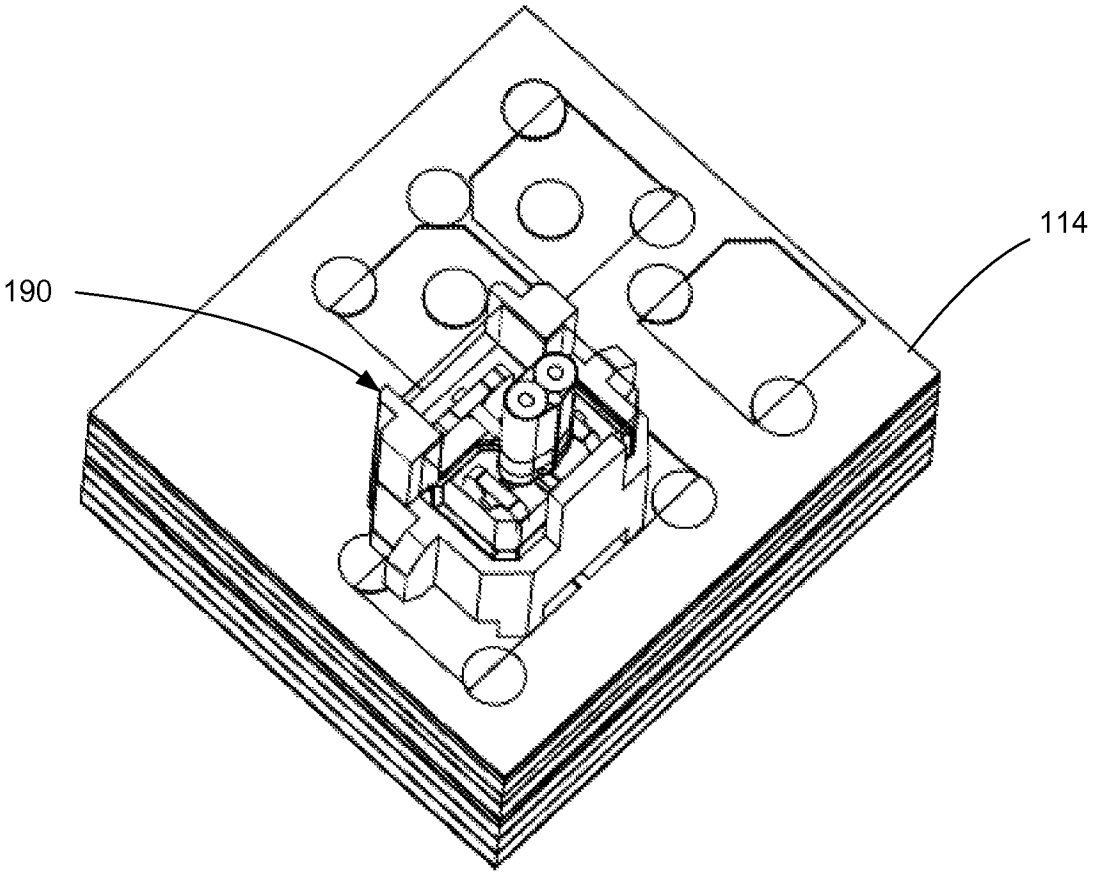
FIG. 11 illustrates a further simplified perspective view of the embodiment depicted in FIG. 10.
Figure 12:
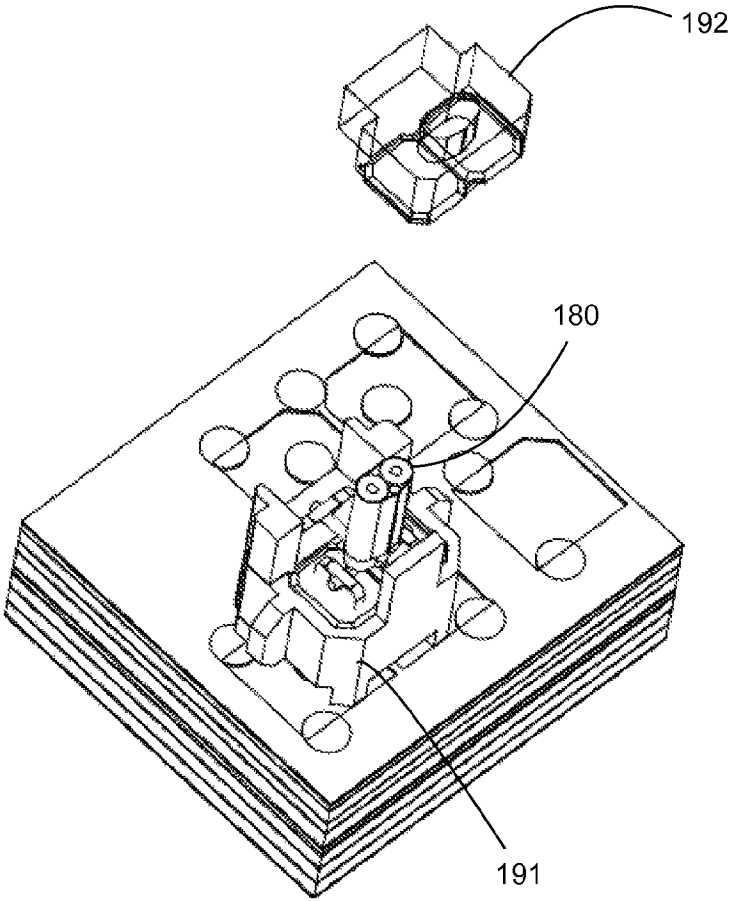
FIG. 12 illustrates a partially exploded perspective view of the embodiment depicted in FIG. 11.
Figure 13:
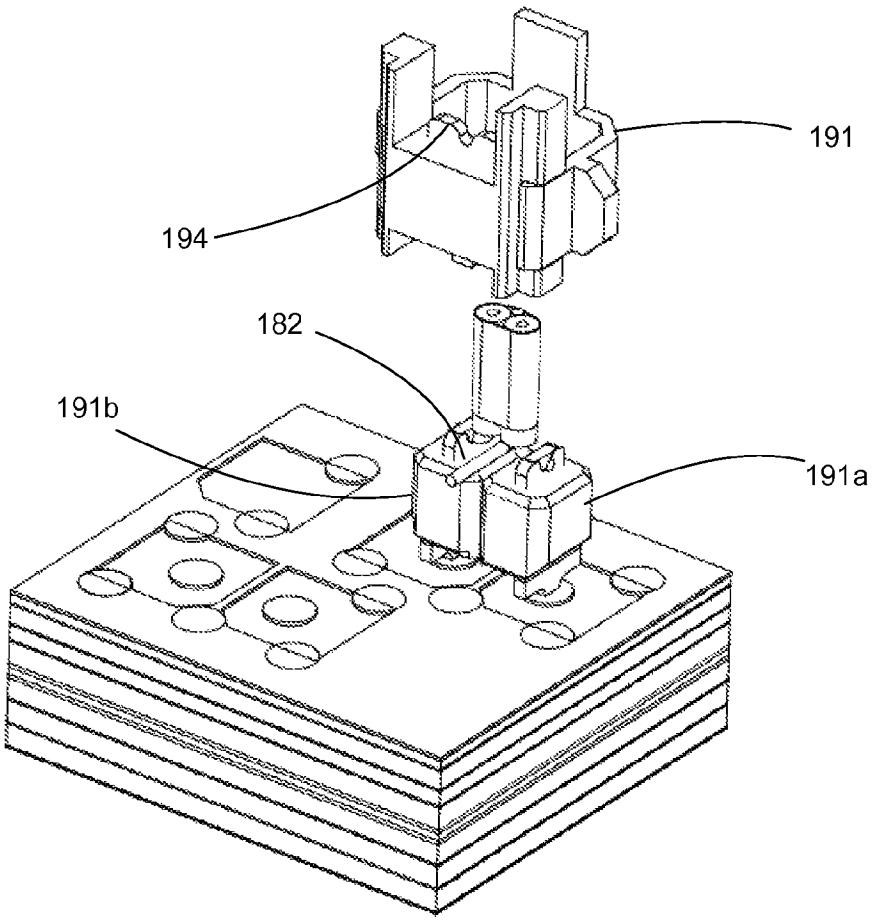
FIG. 13 illustrates a partially exploded simplified perspective view of the embodiment depicted in FIG. 12.
Figure 14:
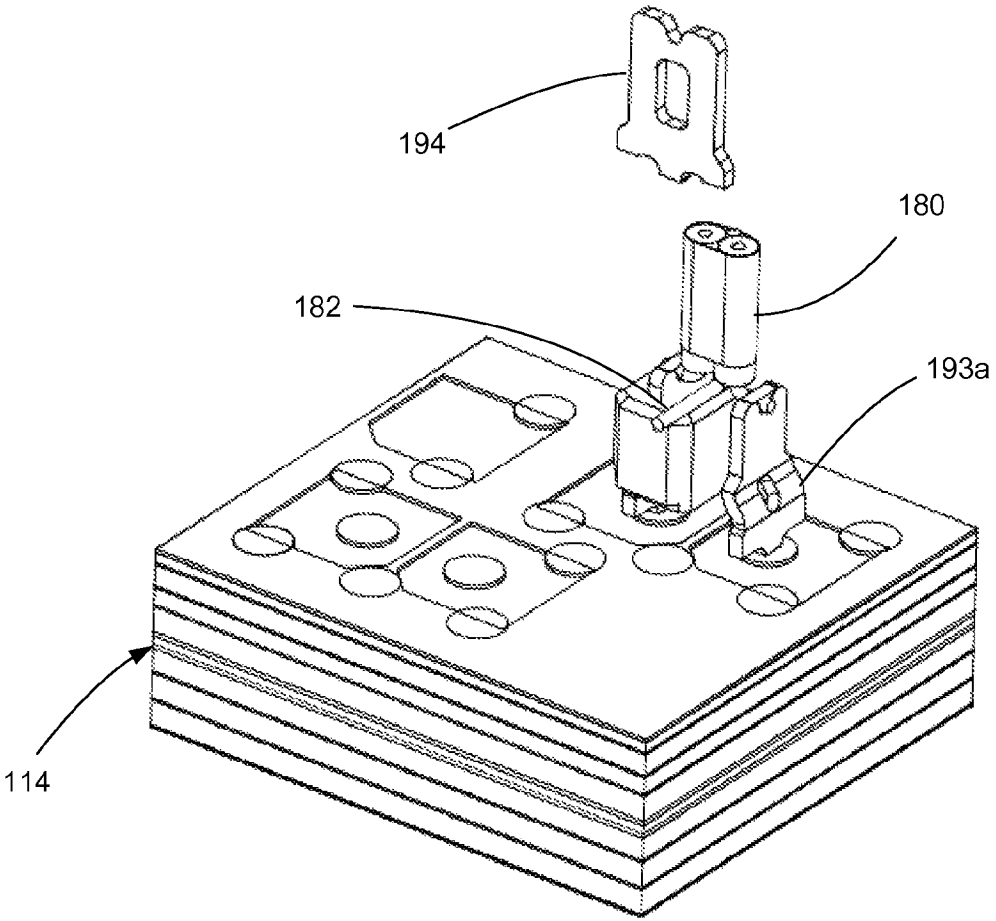
FIG. 14 illustrates a simplified, partially exploded perspective view of the embodiment depicted in FIG. 13.
Figure 15:
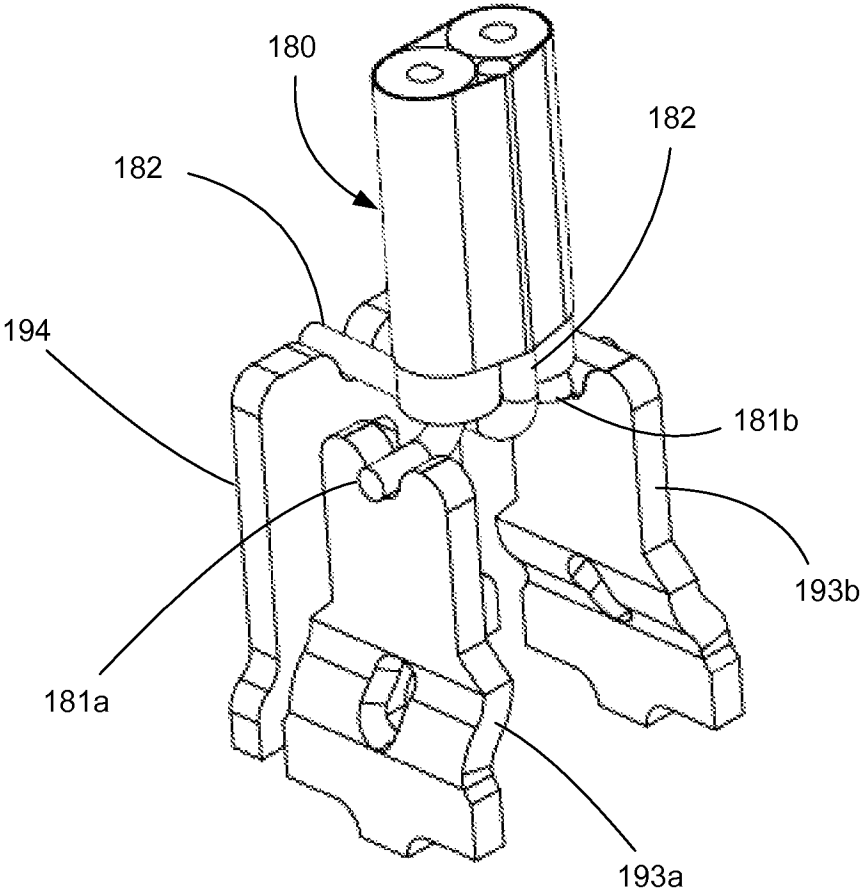
FIG. 15 illustrates a simplified perspective view of the embodiment depicted in FIG. 11 with the housing omitted.
Figure 16:
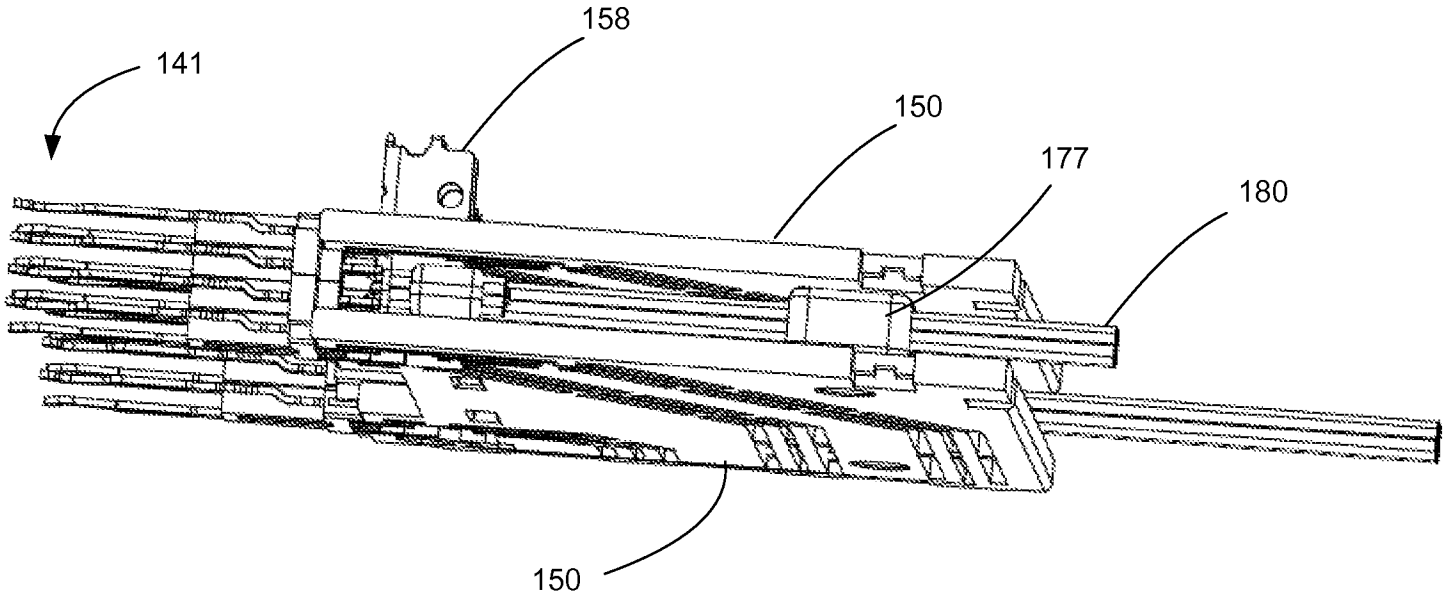
FIG. 16 illustrates a perspective view of an embodiment of a signal module positioned between two ground wafers.
Figure 17:
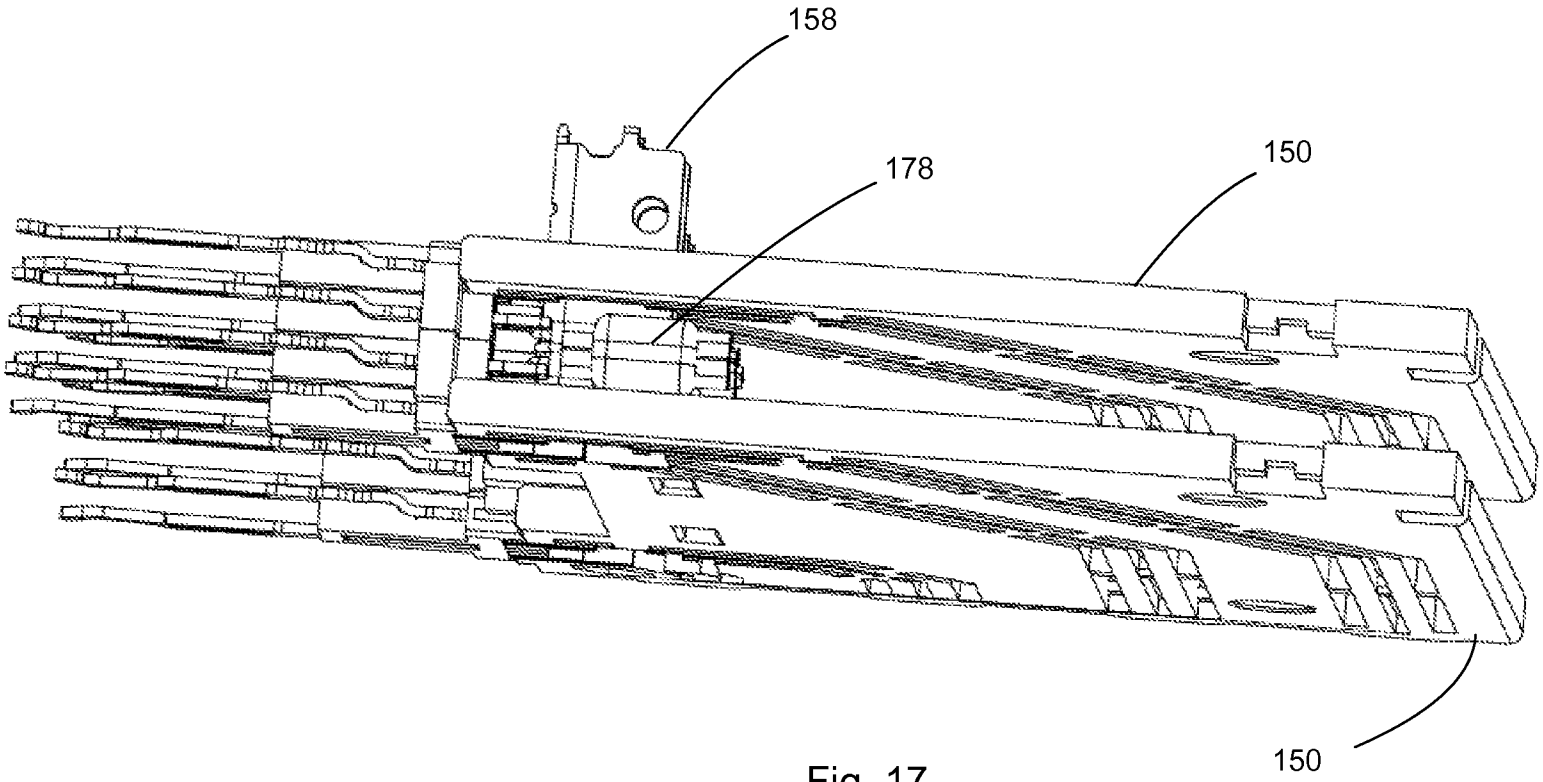
FIG. 17 illustrates a simplified perspective view of the embodiment depicted in FIG. 16.
Figure 18:
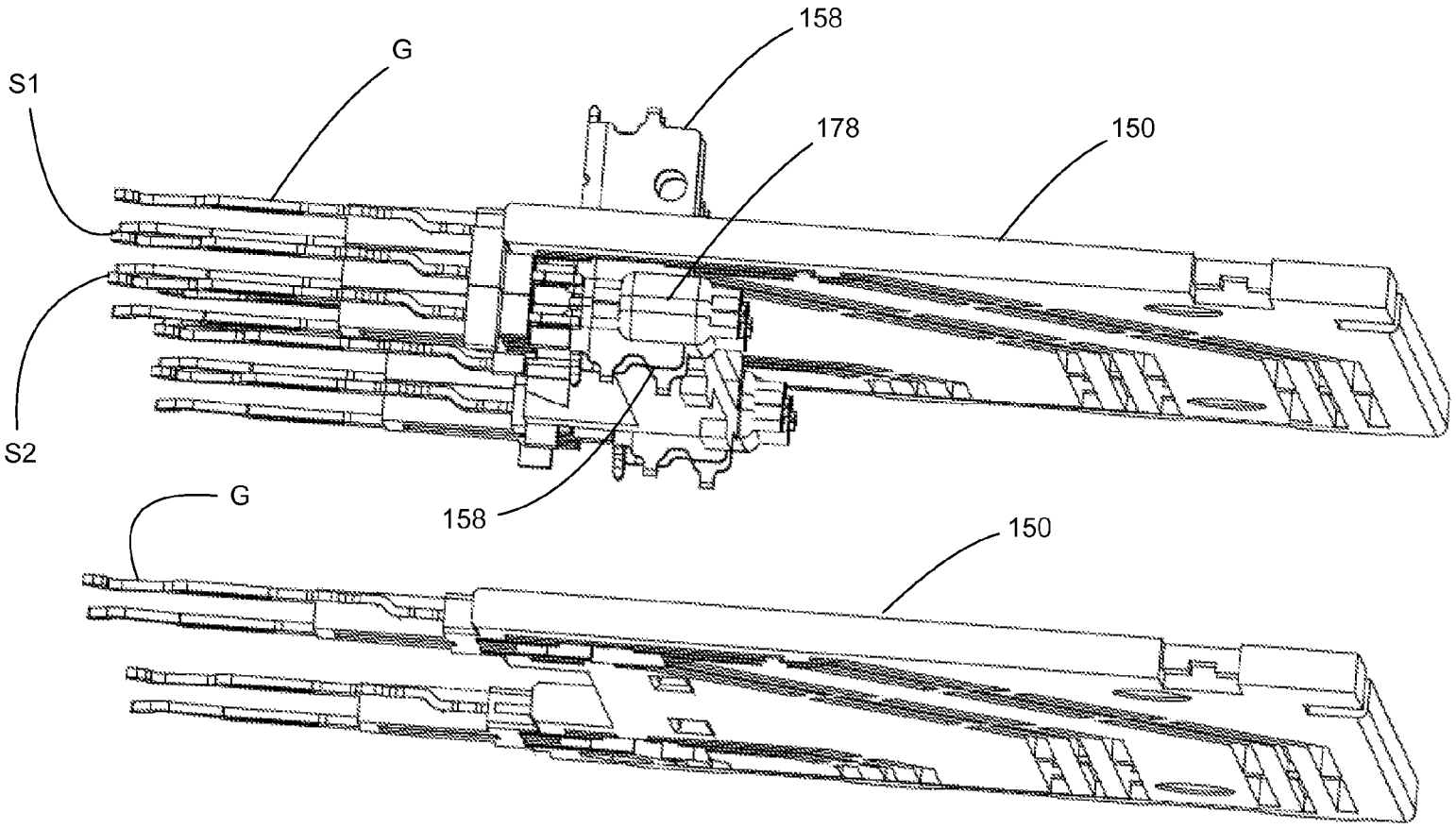
FIG. 18 illustrates a partially exploded perspective view of the embodiment depicted in FIG. 17.
Figure 19:
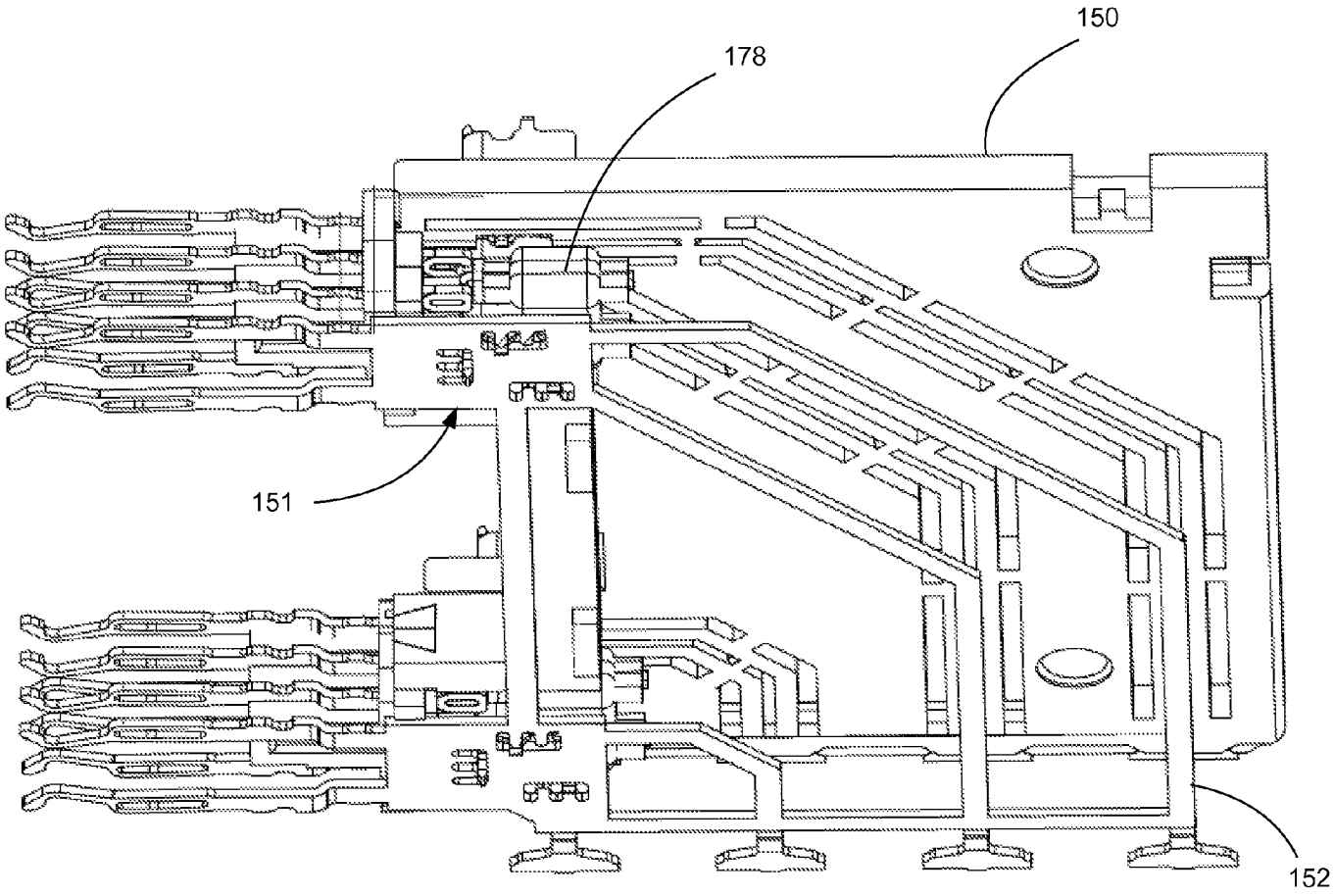
FIG. 19 illustrates a partial perspective view of the embodiment depicted in FIG. 17 with an insulative web of a ground wafer removed.
Figure 20:
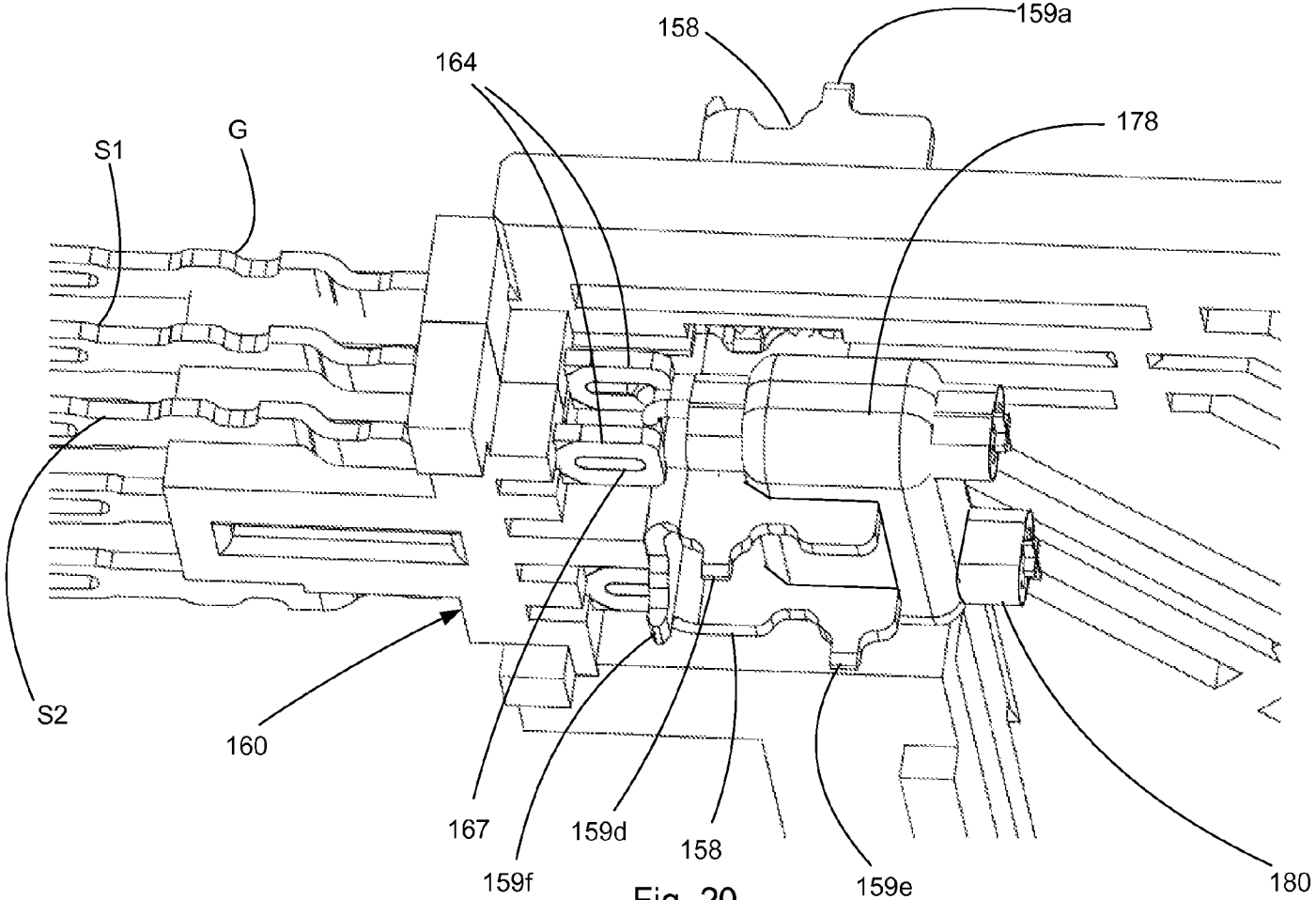
FIG. 20 illustrates a simplified perspective view of the embodiment depicted in FIG. 17 with one of the ground waters removed.
Figure 21:
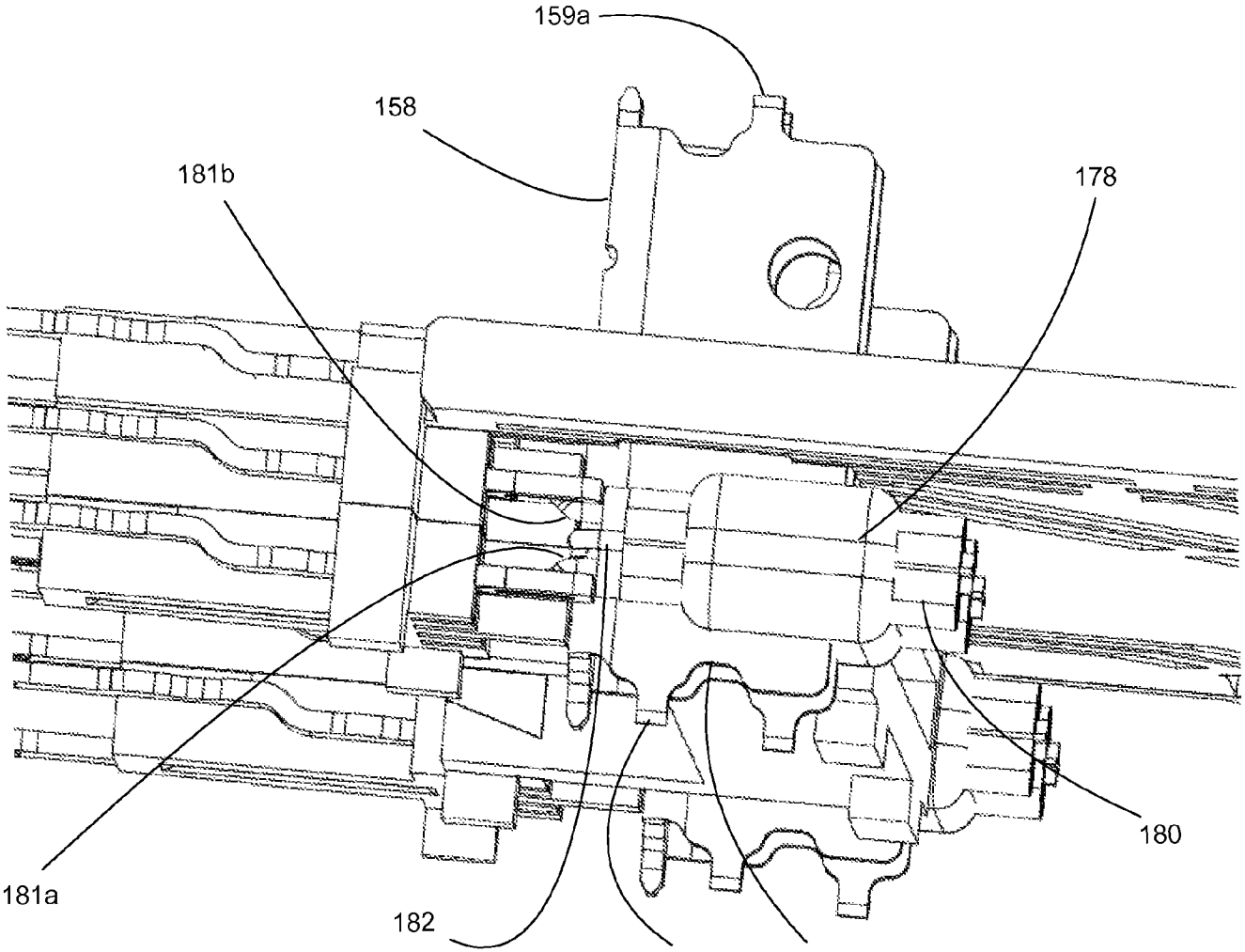
FIG. 21 illustrates an enlarged different perspective view of the embodiment depicted in FIG. 20.
Figure 22:
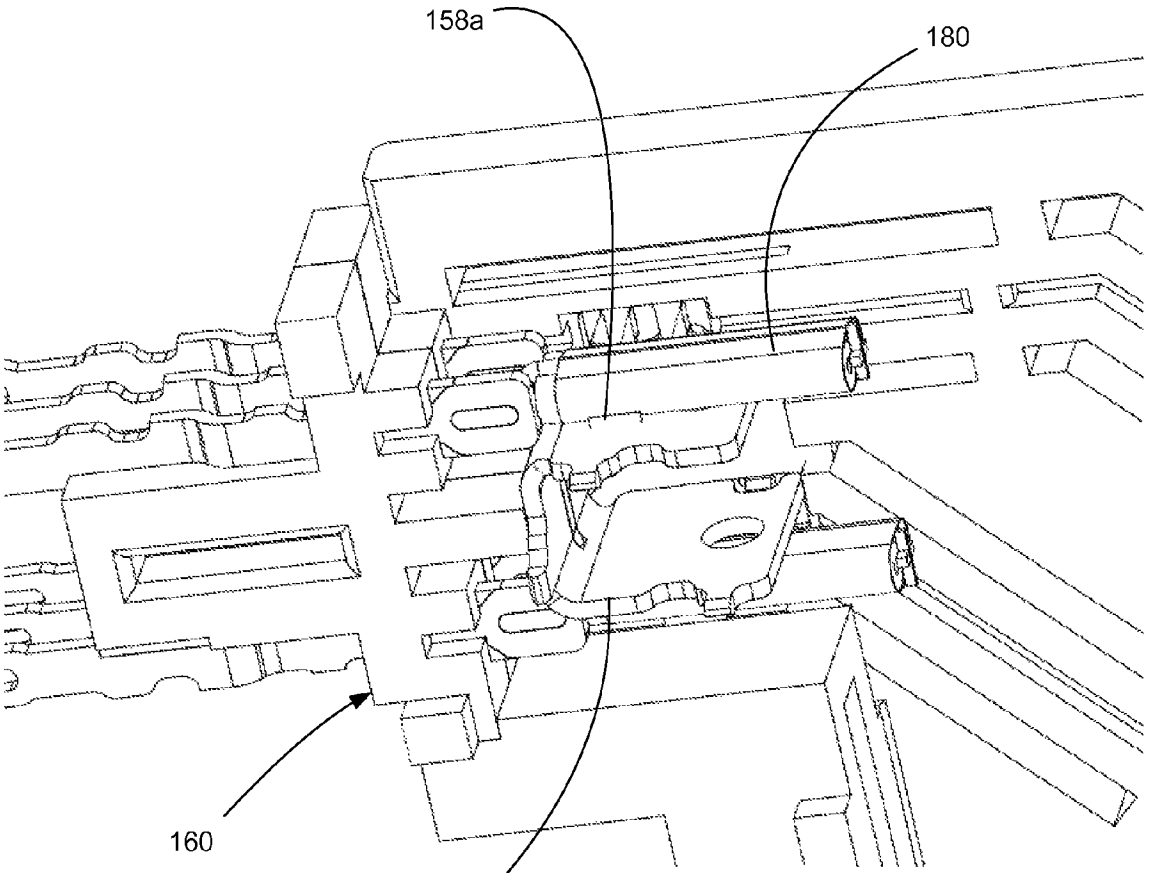
FIG. 22 illustrates a simplified perspective view of the embodiment depicted in FIG. 21.
Figure 23:
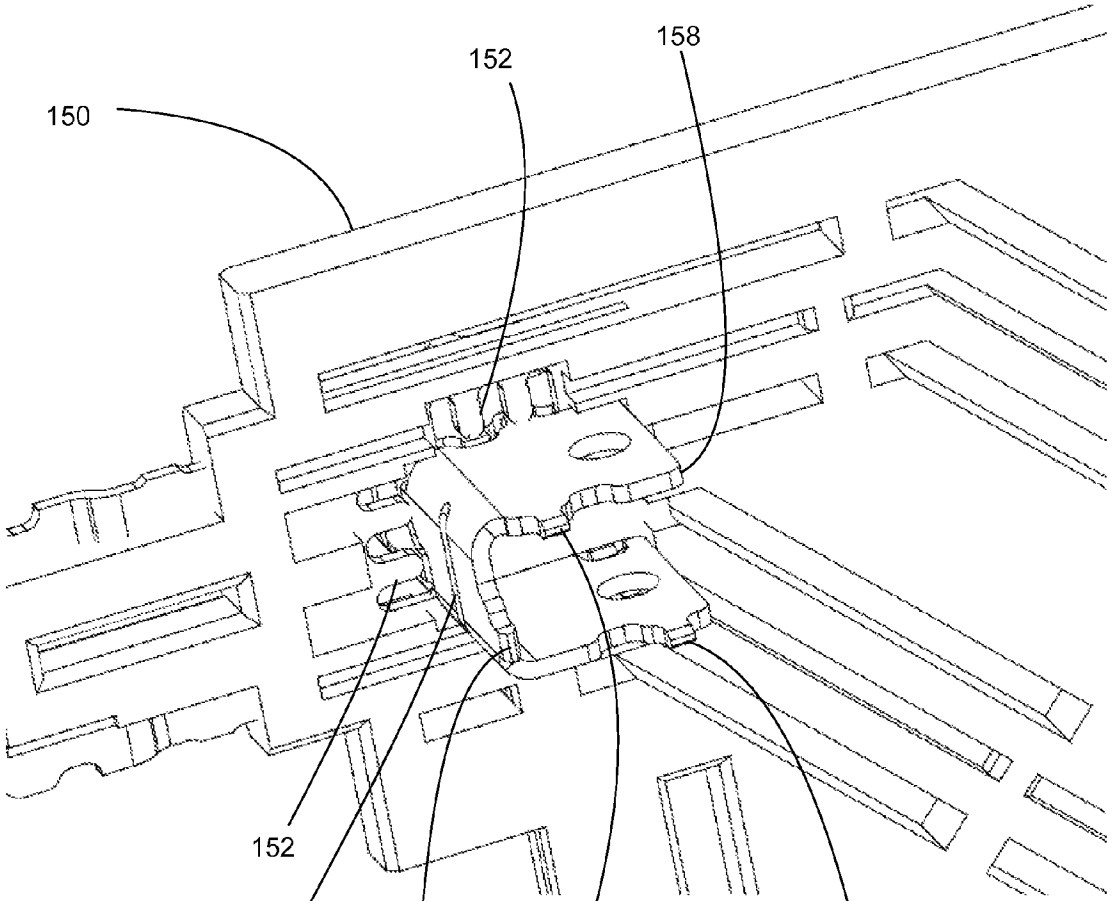
FIG. 23 illustrates a simplified enlarged perspective view of an embodiment of a ground wafer and a U-shield.
Figure 24:
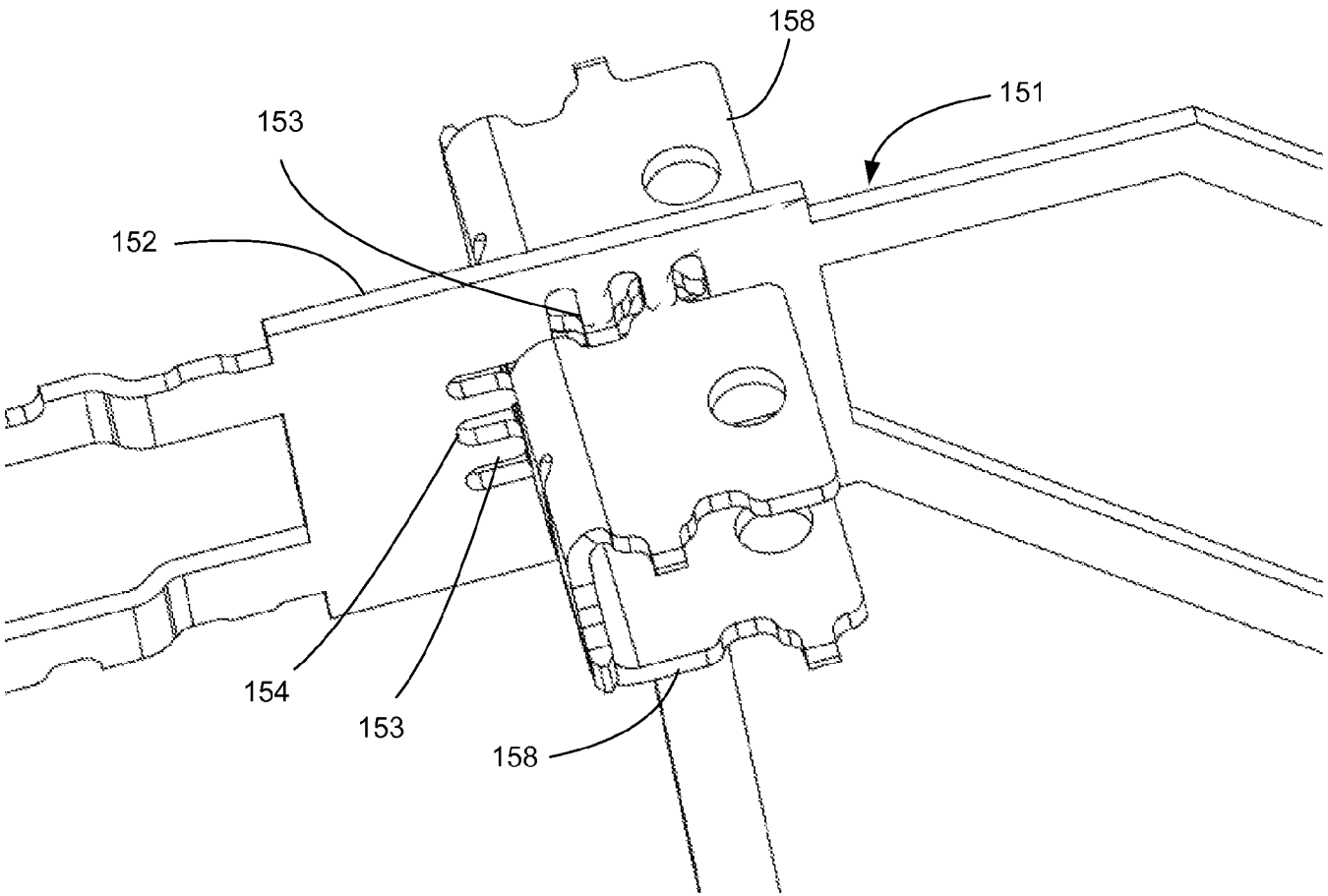
FIG. 24 illustrates a simplified view of the embodiment depicted in FIG. 23 with an insulative web of the ground wafer removed.
Figure 25:
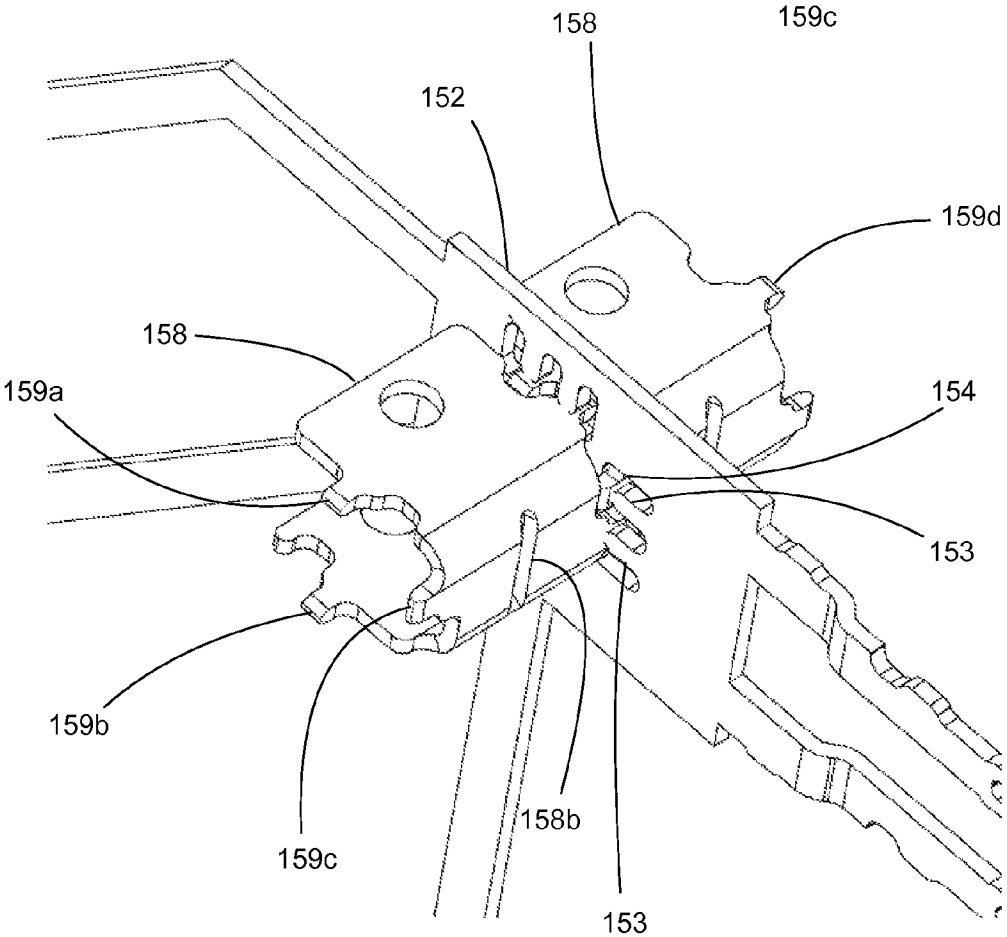
FIG. 25 illustrates another perspective view of the embodiment depicted in FIG. 24.
Figure 26:
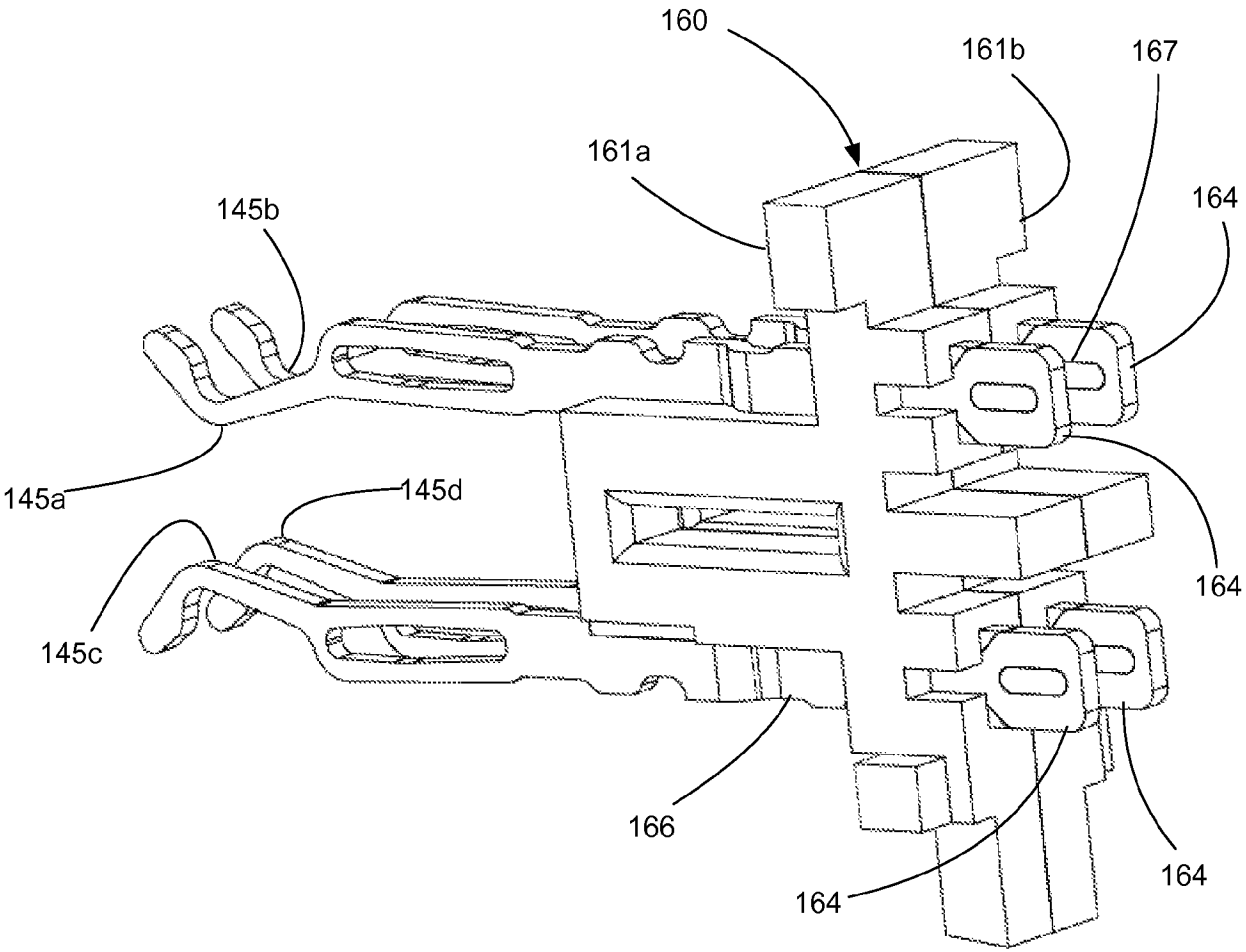
FIG. 26 illustrates a perspective view of an embodiment of a signal module.
Figure 27:
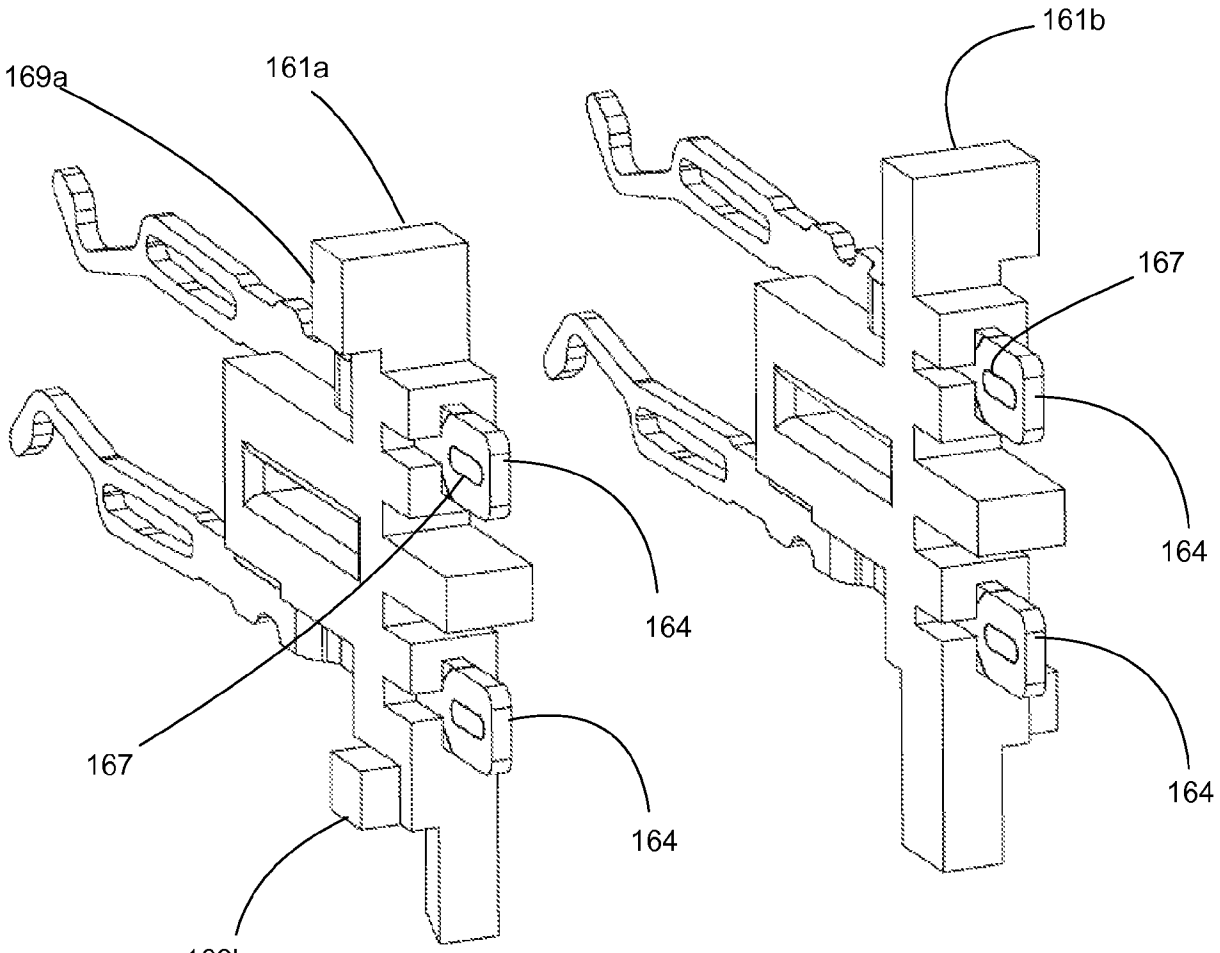
FIG. 27 illustrates a partially exploded perspective view of the embodiment depicted in FIG. 26.

FIG. 4 illustrates a method of providing a connector on a circuit board. First in step 210 a sub-wafer is formed. The sub-wafer can be as depicted herein or could be larger and includes one or more signal terminals. Next in step 220 a second sub-wafer is formed. The second sub-wafer typically will be sized similarly as the first sub-wafer and can include the same number of signal terminals. In step 230, the first and second sub-wafers are joined together to form a signal module. The signal module can consist entirely of signal terminals and if so, typically will be about the same width as two conventional wafers. In step 240, conductors from a cable are terminated to the signal terminals in the signal module. This termination can be done via a solder operation or with the use of conductive epoxy or through a mechanical attachment. In step 250, the signal module with the connected cable is positioned in a housing. The positioning can include arranging a ground wafer on both sides of the signal module. As can be appreciated, multiple signal modules can be positioned in a housing, thus steps 210-250 can be repeated as desired. Finally, when the connector is ready to be mounted, the connector is pressed onto a circuit board. As can be appreciated, as the signal module may not include any terminals with tails that are configured to be attached to a circuit board, the connector will typically include other wafers with press-fit tails (such as the ground wafers and/or low-speed signal wafers).

As can be appreciated, in the above embodiments the number of interfaces can be limited to four interfaces for the high data rate signal channels (contact of first terminal, first cable termination, second cable termination, and press-fit tail to circuit board). In addition, this allows the connector assembly to be formed and then placed onto a circuit board after the various features of the circuit board are soldered in place. This allows for a reliable electrical connection without interfering with the manufacture (and if necessary) reworking of the circuit board. In addition, a low loss cable can provide an attenuation of less than 5 dB up to 15 GHz at 1 meter or about 0.1 dB per inch (which is substantially better than a FR4 board). Thus, a connector system with a 10 inch cable can result in a loss of less than 6 dB (1 dB for the cable and 2.5 dB for each connector) and preferably less than 5 dB of loss (a more reasonably designed press-fit connector should have not more than about 2 dB of loss for each connector) and potentially only 3 dB of loss for the connector system (if the press-fit connector is well optimized it can have a loss of about 1 dB per connector) as compared to a solution routing through FR4 that would result in about 15 dB of loss just for the transmission line through the circuit board (and still would need to account for the loss in the connector).

As can be appreciated, the performance of the connector will depend on a number of factors and thus the loss in a channel between the silicon and the external interface will vary depending on those factors. It is expected, however, that for a 10 inch channel the connector system depicted herein will provide at least a 10 dB improvement compared to a design that uses FR4 circuit board to provide the 10 inch transmission channel, at least for signaling frequencies greater than 10 (kHz. For example, the FR4 board is expected to provide a loss of about 15.5-16 dB for a 10 inch long channel at 13 GHz (e.g., 25 Gbps with NRZ encoding). In contrast, a connector system as disclosed herein can provide a loss of 5 dB at 13 GHz and a more optimized system can provide a solution that has a loss of about 3 dB at 13 GHz. Or to put it another way, the cable solution can potentially provide 1 dB of improvement compared to an FR4 based solution for each inch of distance between the silicon and the external interface in a system communicating at 13 GHz (assuming the communication length is at least 4 inches, for very short lengths it may be more desirable to simply provide a larger connector).

It should be noted that the discussed embodiments primarily discuss the signal terminals. In a functioning signaling system it is expected that at least one ground terminal will be associated with each signal pair in both connectors. In an embodiment, therefore, the ground terminals can be electrically connected to a ground wire (sometimes referred to as a drain wire) provided with the signal wires in an associated cable that extends between the first and second connector.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

I claim:

1. A connector system, comprising:

first connector having a first pair of signal terminals, each of the signal terminals including a tail with a press-fit configuration;

a second connector having a second pair of signal terminals, the second connector further including a plurality of terminals with tails having a press-fit configuration; and a cable with a first end and a second end, the first end of the cable terminated to the first pair of signal terminals, the second end terminated to the second pair of signal terminals.

2. The connector system of claim 1, wherein the second pair of signal terminals have contacts configured to engage a mating connector.

3. The connector system of claim 2, wherein the second pair of terminals are supported by a housing that includes a card slot, the contacts being positioned in the card slot.

4. The connector system of claim 3, wherein the cable includes a ground wire and the ground wire is electrically connected to a first ground terminal in the first connector and a second ground terminal in the second connector.

5. A connector system, comprising:

a housing having a card slot;

a first ground wafer and a second ground wafer supported by the housing, each of the ground wafers having a ground terminal with a contact positioned in the card slot;

a signal module positioned between the first and second ground wafers, the signal module including a first sub-wafer that supports a first signal terminal and further including a second sub-wafer that supports a second signal terminal, each of signal terminals having a contact positioned in the card slot such that the contacts are arranged in a ground, signal, signal, ground pattern; and a cable with a first signal conductor and a second signal conductor and a ground wire, the first signal conductor terminated to the first terminal, the second signal conductor terminated to the second signal terminal and the ground wire electrically connected to ground terminals that form the ground, signal, signal, ground pattern of contacts.

6. The connector system of claim 5, wherein the first and second terminals each include a conductor notch and the respective conductors are terminated in the respective conductor notch.

7. The connector system of claim 6, further comprising U-shield positioned adjacent the conductor notch.

8. The connector system of claim 7, wherein the U-shield electrically couples the ground wire and the ground terminals positioned in the ground wafers.

9. The connector system of claim 8, wherein the ground terminal includes a shield wall with an aperture and a finger is provided in the aperture and the U-shield includes a projection that is configured to engage the finger.

10. A connector system, comprising:

a first connector having a housing, the housing supporting first pair of signal terminals and a ground terminal, the first pair of signal terminals and the ground terminal each including a tail having a press-fit configuration;

a second connector having a first ground wafer and a second ground wafer and a signal module positioned between the first and second ground wafers, each of the first and second ground wafers having a ground terminal with a contact positioned in a card slot and the signal module supporting a second pair signal terminals, each of the second pair of signal terminals including a contact positioned in the card slot, the contacts of the second pair of signal terminals positioned between the contacts of the first and second ground terminals; and a cable with a first end and a second end, the first end of the cable terminated to the first pair of signal terminals, the second end terminated to the second pair of signal terminals.

11. The connector system of claim 10, further comprising a frame that supports the first connector.

12. The connector system of claim 10 wherein the cable includes a ground wire and the ground wire is electrically connected to the ground terminal of the first connector and to both the ground terminals in the second connector.

13. The connector system of claim 12, wherein the second connector includes a U-shield positioned adjacent where the second end is terminated, the U-shield electrically connected to the ground terminals.

14. The connector system of claim 13, wherein the ground wire is terminated to the U-shield.

* * * * *